US012221846B1

(12) United States Patent
Beard et al.

(10) Patent No.: US 12,221,846 B1
(45) Date of Patent: Feb. 11, 2025

(54) LINEAR GREASE AND HYDRAULIC VALVE FOR FRACKING SYSTEM MAINTENANCE

(71) Applicant: PacSeal Group, Inc., Brea, CA (US)

(72) Inventors: Joseph Owen Beard, Fullerton, CA (US); Frode Sveen, Chino, CA (US); Douglas W. Beard, Brea, CA (US)

(73) Assignee: PacSeal Group, Inc., Brea, CA (US)

( * ) Notice: Subject to any disclaimer, the term of this patent is extended or adjusted under 35 U.S.C. 154(b) by 0 days.

(21) Appl. No.: 18/652,613

(22) Filed: May 1, 2024

(51) Int. Cl.
*E21B 33/03* (2006.01)
*E21B 43/26* (2006.01)

(52) U.S. Cl.
CPC ..... *E21B 33/03* (2013.01); *E21B 43/2607* (2020.05)

(58) Field of Classification Search
CPC ..... E21B 33/03; E21B 43/2607
See application file for complete search history.

(56) References Cited

U.S. PATENT DOCUMENTS

| | | | | |
|---|---|---|---|---|
| 10,982,808 | B2 * | 4/2021 | Zerkus | F16N 7/385 |
| 11,137,109 | B2 * | 10/2021 | Babineaux | F16N 11/08 |
| 11,480,028 | B2 * | 10/2022 | Beason | F16N 7/40 |
| 11,814,939 | B2 * | 11/2023 | Viator | E21B 34/02 |
| 11,988,329 | B1 * | 5/2024 | Horvath | E21B 43/2607 |
| 2022/0186583 | A1 * | 6/2022 | Cain | F16N 13/22 |

* cited by examiner

*Primary Examiner* — Matthew R Buck
(74) *Attorney, Agent, or Firm* — Knobbe Martens Olson & Bear LLP

(57) ABSTRACT

A fracking stack assembly coupled with a wellhead is disclosed. The fracking stack assembly can include a linear shear-flow controller configured to deliver the flow of pressurized lubricant to the fracking valve. The linear shear-flow controller can include a housing around an interior space, a supply port receiving a flow of pressurized lubricant, an outlet port; and a slide having a first end and a second end disposed within the interior space and movable along a linear axis. A first side of the slide can sealingly engage with a first sealing ring, and a second side of the slide can sealingly engage with a second sealing ring, such that the slide is slideable along the linear axis between blocked and open positions.

21 Claims, 15 Drawing Sheets

LINEAR GREASE AND HYDRAULIC VALVE FOR FRACKING SYSTEM MAINTENANCE

BACKGROUND

Field

This disclosure generally relates to a linear grease and hydraulic valve system for maintenance of fracking stacks used in hydraulic fracturing operations.

Related Art

Advancements have been made to improve the maintenance and performance of fracking stacks in hydraulic fracturing operations. As parts of the fracking stack undergo continual use, the importance of maintaining operability and performance increase. Solutions have been developed to address the challenges posed by use and maintenance requirements as well as demands for performance.

SUMMARY

For purposes of summarizing the disclosure and the advantages achieved over the prior art, certain objects and advantages of the disclosure are described herein. Not all such objects or advantages may be achieved in any particular embodiment. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these implementations are intended to be within the scope of the invention herein disclosed. These and other implementations will become readily apparent to those skilled in the art from the following detailed description of the preferred implementations having reference to the attached figures, the invention not being limited to any particular preferred implementations disclosed.

In some implementations, a fracking stack assembly coupled with a wellhead can include: a hydraulic pump and a motor for powering the hydraulic pump; at least one lubricant reservoir for providing a flow of pressurized lubricant; at least one conduit hydraulically coupling the hydraulic pump with the at least one lubricant reservoir, wherein the hydraulic pump pressurizes the flow of pressurized lubricant; a fracking valve including a cavity within a body of the fracking valve; a linear shear-flow controller configured to deliver the flow of pressurized lubricant to the fracking valve including: a housing including a housing around an interior space; a supply port receiving the flow of pressurized lubricant and including first and second apertures in the housing, a first ring holder disposed in the first aperture and a first seal ring coupled within the first ring holder, a second ring holder disposed in the second aperture and a second seal ring coupled within the second ring holder; an outlet port, including third aperture in the housing, a third ring holder disposed in the third aperture; and a slide having a first end and a second end disposed within the interior space and movable along a linear axis, the slide including a first side and a second side opposite the first side, an inner passage and a center aperture extending through the slide between the first and the second end, the center aperture connected to a through port extending through the slide; wherein the first side of the slide sealingly engages with the first sealing ring, and the second side of the slide sealingly engages with the second sealing ring, the slide slideable along the linear axis between blocked and open positions; wherein in the blocked position of the slide, the center aperture is aligned between the supply port and outlet port and aligned along with the first and second sealing rings, wherein the pressurized lubricant flows through the first and second sealing rings and the inner passage; and wherein in the open position of the slide, the center aperture is aligned with the supply port allowing the pressurized lubricant to enter a body-cavity through the through port and exit through the outlet port to form a flow path for the flow of pressurized lubricant to the cavity of the fracking valve.

In some implementations, the linear shear-flow controller is configured such that in the blocked position and the open position, equal pressure is applied on the first and second sides of the slide by the flow of pressurized lubricant. In some implementations, the flow path is configured to remove debris from the cavity of the fracking valve. In some implementations, the fracking stack assembly can include a piston coupled with the first end of the slide and disposed within a cylinder having first and second pilot ports for moving the slide between the first position and the second position.

In some implementations, the fracking stack assembly can include a spring coupled with the first end of the slide for biasing the slide into the blocked position. In some implementations, the fracking stack assembly includes: a first piston coupled with the first end of the slide and disposed within a first cylinder having first and second pilot ports for moving the slide into the open position; and a spring coupled with the slide for biasing the slide into the blocked position.

In some implementations, an oil well fracking stack assembly coupled with a wellhead can include: a hydraulic pump and a motor for powering the hydraulic pump; at least one pressure accumulator tank for providing a flow of pressurized lubricant; at least one conduit hydraulically coupling the hydraulic pump with the at least one pressure accumulator tank; a fracking valve including a cavity within a body of the fracking valve; a linear shear-flow valve for delivering the flow of pressurized lubricant at a set pressure to the cavity of the fracking valve including: a valve assembly including: a housing having an interior volume; an inlet port coupled with the at least one pressure accumulator tank and receiving the flow of pressurized lubricant, the inlet port including first and second openings in the housing, a first holder disposed in the first opening and a first ring coupled within the first holder, a second holder disposed in the second opening and a second ring coupled within the second holder; an outlet port including a third opening in the housing, a third holder disposed in the third opening and a third ring coupled within the third holder; a movable member disposed within the interior volume and movable along a linear axis, the movable member including a first face and a second face opposite the first face, a closed valve aperture, and an open valve aperture in communication with the interior volume; wherein in a closed position of the movable member, the closed valve aperture is aligned with the inlet port, in an open position of the movable member, the open valve aperture is aligned with the inlet port; and a pressure set assembly coupled with a first end of the movable member and configured to apply a set force to the movable member, the set force corresponding to the set pressure; wherein when a pressure within the interior volume is below the set pressure, the set force moves the movable member into the open position; and wherein when the pressure within the interior volume is at the set pressure, the movable member moves into the closed position.

In some implementations, the pressure set assembly can include: a first piston coupled to the first end of the moveable member; and a second piston and a spring coupled to a second end of the moveable member, the spring configured for biasing the moveable member into any of the open or closed configurations, depending on the configuration of the spring. In some implementations, the pressure set assembly further includes a pilot for receiving a pilot pressure, the pilot pressure in communication with the first end of the movable member and the pilot pressure of the pilot adjustable to modify the set force. In some implementations, the pilot is a hydraulic pilot and further including a fluid compensator in fluid communication with the hydraulic pilot and the first end of the movable member. In some implementations, the fracking stack assembly can include a fail-safe operator including a spring configured to automatically exert an opening force on the first end of the movable member when the pilot pressure falls below a set threshold. In some implementations, the fracking stack assembly can include a manifold, the manifold can include: a main lubricant supply input conduit; a plurality of apertures disposed on a first face and a second face of the manifold connected with the main lubricant supply input conduit, the plurality of apertures fluidly connects the main lubricant supply input conduit to the inlet port; and a second plurality of apertures disposed on the first face and the second face of the manifold connected with a plurality of output lubricant supply conduits, wherein the second plurality of apertures fluidly connects to the outlet port.

In some implementations, an oil well fracking stack assembly coupled with a wellhead can include: a hydraulic pump and a motor for powering the hydraulic pump; at least one pressure accumulator tank for providing a flow of pressurized lubricant; at least one conduit hydraulically coupling the hydraulic pump with the at least one pressure accumulator tank; a fracking valve including a cavity within a body of the fracking valve; a valve controller for delivering the flow of pressurized lubricant to the fracking valve including: a manifold including: a main lubricant supply input conduit; a plurality of apertures disposed on a first face and a second face of the manifold connected with the main lubricant supply input conduit; and a second plurality of apertures disposed on the first face and the second face of the manifold connected with a plurality of output lubricant supply conduits; a linear shear-flow valve having a first side coupled to the manifold and including: a housing having an interior space; a first port including first and second apertures in the housing, a first ring holder disposed in the first aperture and a first seal ring coupled within the first ring holder, a second ring holder disposed in the second aperture and a second seal ring coupled within the second ring holder, wherein in the first port is in fluid communication with a first aperture of the plurality of apertures; a second port, including a third aperture in the housing, a third ring holder disposed in the third aperture, wherein the second port is in fluid communication with the second plurality of apertures; and a first slide disposed within the interior space and movable along a first linear axis, the first slide including a first side and a second side opposite the first side, a closed valve aperture, and an open valve aperture in communication with the second port; wherein the first side of the first slide sealingly engages with the first scal ring, and the second side of the first slide sealingly engages with the second sealing ring, the first slide slideable along the first linear axis between a return position, in which the closed valve aperture is aligned with the first port, and a supply position, in which the open valve aperture is aligned with the first port.

In some implementations, an equal pressure is applied on the first and second sides of the first slide by the flow of pressurized lubricant in the closed position. In some implementations, the second plurality of apertures are coupled with the cavity of the second fracking valve. In some implementations, the fracking stack assembly can include a slide actuator having a cylinder having a piston disposed therein, the piston coupled with the first slide.

In some implementations, the linear shear-flow valve includes a pilot port, the pilot port in communication with the cylinder of the slide actuator and configured to move the piston and the first slide. In some implementations, the fracking stack assembly can include a spring for biasing the first slide into a blocked position.

In some implementations, a fracking stack assembly coupled with a wellhead can include: a hydraulic pump and a motor for powering the hydraulic pump; at least one lubricant reservoir for providing a flow of pressurized lubricant; at least one conduit hydraulically coupling the hydraulic pump with the at least one lubricant reservoir; a fracking valve including a cavity within a body of the fracking valve; a linear shear-flow controller delivering the flow of pressurized lubricant to the fracking valve including: a housing including a housing around an interior space; a supply port receiving the flow of pressurized lubricant and including first and second apertures in the housing, a first ring holder disposed in the first aperture and a bidirectional seal coupled within the first ring holder, a second ring holder disposed in the second aperture and a seal ring coupled within the second ring holder; an outlet port, including third aperture in the housing, a third ring holder disposed in the third aperture; and a slide having a first end and a second end disposed within the interior space and movable along a linear axis, the slide including a first side and a second side opposite the first side, an inner passage and a center aperture extending through the slide between the first and the second end, the center aperture connected to a through port extending through the slide; wherein the first side of the slide sealingly engages with the bidirectional seal, and the second side of the slide sealingly engages with the sealing ring, the slide slideable along the linear axis between blocked and open positions; wherein in the blocked position of the slide, the center aperture is aligned between the supply port and outlet port and aligned along with the first and second sealing rings, wherein the pressurized lubricant flows through the first and second sealing rings and the inner passage; and wherein in the open position of the slide, the center aperture is aligned with the supply port allowing the pressurized lubricant to enter a body-cavity through the through port and exit through the outlet port to form a flow path for the flow of pressurized lubricant to the cavity of the fracking valve.

In some implementations, the flow path is configured to remove debris from the cavity of the fracking valve.

BRIEF DESCRIPTION OF THE DRAWINGS

Various implementations will be described hereinafter with reference to the accompanying drawings. These implementations are illustrated and described by example only and are not intended to limit the scope of the disclosure. In the drawings, similar elements have similar reference numerals. It is to be understood that the accompanying drawings, which are incorporated in and constitute a part of this specification, are for the purpose of illustrating concepts disclosed herein and may not be to scale.

DESCRIPTION

Figure 1:
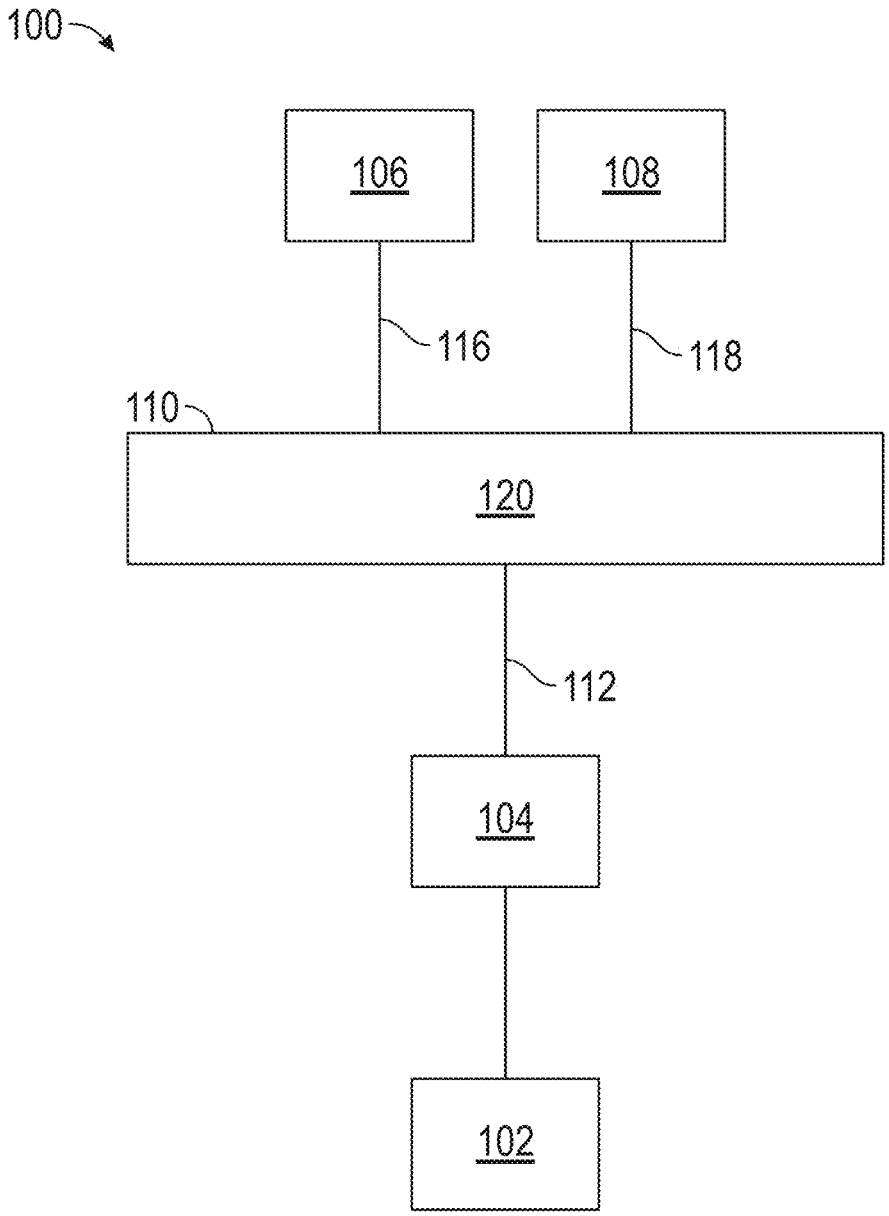
FIG. 1 illustrates a schematic overview of a frack stack assembly.

The present disclosure may be understood by reference to the following detailed description. It is noted that, for purposes of illustrative clarity, certain elements in various drawings may not be drawn to scale, may be represented schematically or conceptually, or otherwise may not correspond exactly to certain physical configurations of embodiments.

Although several embodiments, examples, and illustrations are disclosed below, it will be understood by those of ordinary skill in the art that the inventions described herein extend beyond the specifically disclosed embodiments, examples, and illustrations and includes other uses of the inventions and obvious modifications and equivalents thereof. Embodiments are described with reference to the accompanying figures, wherein like numerals refer to like elements throughout. The terminology used in the description presented herein is not intended to be interpreted in any limited or restrictive manner simply because it is being used in conjunction with a detailed description of some specific embodiments of the inventions. In addition, embodiments can comprise several novel features. No single feature is solely responsible for its desirable attributes or is essential to practicing the inventions herein described. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

Oil and gas wells are used to recover subterranean fossil fuels. Hydraulic fracturing, commonly known as "fracking," is a process in the extraction of natural gas and oil from deep rock formations. This method involves injecting high-pressure fluid into underground rock formations to create fractures, allowing the release of hydrocarbons trapped within the rocks. The hydraulic fracturing process begins with drilling a wellbore using a drill string deep into the Earth's crust, typically several thousand feet below the surface. Once the well reaches the target depth, a perforating gun is employed to create holes in the well casing, allowing access to the rock formation. Next, a mixture of water, sand, and chemical additives—known as fracking fluid or proppant—is injected into the well under extremely high pressure. This fluid helps to create fractures in the rock, and the sand holds these fractures open, facilitating the flow of oil and gas to the surface.

The equipment installed on the wellhead is called a "frack stack" which can contain numerous gate-type frack valves that are usually hydraulic actuated from a remote source. The frack valves open and close by sliding a seal, such as a gate, in and out of a pocket or cavity inside of the valve body which is exposed to well bore fluids. When the frack valve is closed, blocking flow in or out of the wellbore, the gate pocket is exposed to well bore fluids and will become filled with sand and other solids. This will prevent the gate from sliding into the pocket and thus the Frack Valve from being opened to allow fluid to flow.

To prevent the accumulation of solids in the gate pocket, a lubricant such as grease is pumped into the pocket cavity from an outside source thru a dedicated port in the frack valve body. The lubricant can be injected through a hose and/or supply line that can extend 150 feet or more from the frack valve. The supply lines can be connected to a high pressure manifold assembly (for example, at least 10,000 psi rated, at least 15,000 psi rated or 10,000 to 20,000 psi rated) in which one or more 2-way valves are supplied the lubricant from a pump and lubricant reservoir. The high pressure from the pump is used to overcome the well bore pressure inside of the Frack Valve body to clear any solids collected in the cavity.

FIG. 1 illustrates a schematic diagram of a frack stack assembly 100. As described above, fracking valves can be used to control the flow of fluids within a well bore during fracking operations. The frack stack assembly 100 can include hydraulic components common to frack stacks, as well as innovations of the present disclosure described below. The frack stack assembly 100 can include a lubricant reservoir 102 (i.e., a pressure accumulator tank) for storing a lubricant (e.g., grease). The lubricant reservoir 102 can be coupled with a high-pressure pump 104. The high-pressure pump 104 can be coupled with the with a manifold 110 by a supply line 112. The manifold 110 can include a plurality of high pressure two-way valves 120 for distributing the high-pressure lubricant to a first and second fracking control valves 106, 108 (e.g., gate valves) along first and second flow paths 116, 118. In some instances, the supply line 112 can be coupled with the manifold 110. The plurality of high pressure two-way valves 120 can be mounted directly on the manifold 110 (e.g., in a modular arrangement). The manifold 110 can include a supply passageway for delivering the hydraulic supply fluid to the first and second control valves 106, 108.

A frack stack assembly 100 can include numerous valves similar to the first and second control valves 106, 108 which can be hydraulically actuated from a remote source. The first and second control valves 106, 108 can include a member (i.e., gate) that slides from an open first position into a closed second position. In the first position, the wellbore fluid can flow through the first and second control valves 106, 108. In the second position, the member can slide into a cavity (i.e., pocket gate) within the valve body, which, during fracking operations, can be exposed to wellbore fluids. When the first and second control valves 106, 108 are closed (i.e., blocking flow in and/or out of the wellbore), the cavity can be exposed to the wellbore fluids and can also become filled with debris such as sand, other solids, and proppant. Said debris accumulating in the cavity can prevent the member from sliding into the cavity resulting in the first and second control valves 106, 108 being prevented from opening to the first position to allow the wellbore fluid to flow. In order to prevent said debris from accumulating in the cavity, lubricant is pumped into said cavity by the high-pressure pump 104 to the manifold 110 and plurality of high pressure two-way valves 120 and through a port (e.g., a dedicated port) in the body first and second control valves 106, 108.

The first and second flow paths 116, 118 can be coupled (i.e., in fluid communication) with the first and second control valves 106, 108, respectively. The first and second flow paths 116, 118 can comprise an opening perpendicular to the flow of the lubricant. In some implementations, the flow path opening of the first and second flow paths 116, 118 can comprise a smaller area than that of an opening of the supply line 112. In such a configuration, the first and second flow paths 116, 118 can act as a nozzle for distributing the high-pressure lubricant to the cavity of the first and second control valves 106, 108. For example, in some implementations, the flow path opening of the first and second flow paths 116, 118 at the location of the cavity of the first and second control valves 106, 108 can be at least 20% smaller, at least 40% smaller, at least 60% smaller, and at least 90% smaller than the opening of the supply line 112. In some implementations, the flow path opening of the first and second flow paths 116, 118 upstream of and within 1 inch of the cavity of the first and second control valves 106, 108 can be at least 20% smaller, at least 40% smaller, at least 60% smaller, and at least 90% smaller than the opening of the supply line 112. In some implementations, the flow path opening of the first and second flow paths 116, 118 upstream of and within 2 inches of the cavity of the first and second control valves 106, 108 can be at least 20% smaller, at least 40% smaller, at least 60% smaller, and at least 90% smaller than the opening of the supply line 112. In some implementations, the flow path opening of the first and second flow paths 116, 118 upstream of and within 4 inches of the cavity of the first and second control valves 106, 108 can be at least 20% smaller, at least 40% smaller, at least 60% smaller, and at least 90% smaller than the opening of the supply line 112. In some implementations, the flow path opening of the first and second flow paths 116, 118 upstream of and within 6 inches of the cavity of the first and second control valves 106, 108 can be at least 20% smaller, at least 40% smaller, at least 60% smaller, and at least 90% smaller than the opening of the supply line 112. Additionally, in some implementations, the supply line 112 and the first and second flow paths 116, 118 can comprise similar dimensions to maintain consistent fluid properties from the pump high-pressure pump 104 to the first and second control valves 106, 108. In some implementations, the area of the opening of the first and second flow paths 116, 118 for distributing the pressurized lubricant is between about 1 $in^2$ to 100 $in^2$, between about 1.25 $in^2$ to 90 $in^2$, between about 1.5 $in^2$ to 85 $in^2$, between about 1.75 $in^2$ to 75 $in^2$, between about 2 $in^2$ to 70 $in^2$, about between 2.5 $in^2$ to 65 $in^2$, between about 0.5 $in^2$ to 25 $in^2$, between about 1 $in^2$ to 22.5 $in^2$, between about 1.25 $in^2$ to 20 $in^2$, between about 1.5 $in^2$ to 17.5 $in^2$, between about 2 $in^2$ to 15 $in^2$, between about 0.5 $in^2$ to 9 $in^2$, between about 0.75 $in^2$ to 8.75 $in^2$, between about 1 $in^2$ to 8.5 $in^2$, between about 1.25 $in^2$ to 8.25 $in^2$, between about 1.5 $in^2$ to 8 $in^2$, between about 1.75 $in^2$ to 7.75 $in^2$, between about 2 $in^2$ to 7.5 $in^2$, between about 2.25 $in^2$ to 7.25 $in^2$, between about 2.5 $in^2$ to 7 $in^2$, between about 2.75 $in^2$ to 6.75 $in^2$, or between about 3 $in^2$ to 6.5 $in^2$. In some implementations, the first and second flow paths 116, 118 can pass through the manifold 110 and the plurality of high pressure two-way valves 120. The manifold 110 can include multiple passageways for routing the first and second flow paths 116, 118 through the manifold 110 and the first and second control valves 106, 108.

In addition, the frack stack assembly 100 can include any number of frack stacks and corresponding control valves coupled with the manifold 110. The frack stacks can be arranged vertically, or in a stack, along the drill string at the upper end of the well bore. The hydraulic control elements (e.g., lubricant reservoir 102, high-pressure pump 104, control valves 106, 108, manifold 110, plurality of high pressure two-way valves 120) can be located spaced away from the stack and connected by the flow paths (e.g., flow paths 116, 118, etc.). The supply line 112 can connect the high-pressure pump 104 to the two-way high-pressure valves 120 of the manifold 110. In some implementations, the grease can be injected up to 20,000 psi. In other implementations, the grease can be injected up to 6,000 psi. The high pressure can overcome the wellbore pressure inside the first and second control valves 106, 108.

Figure 2A:
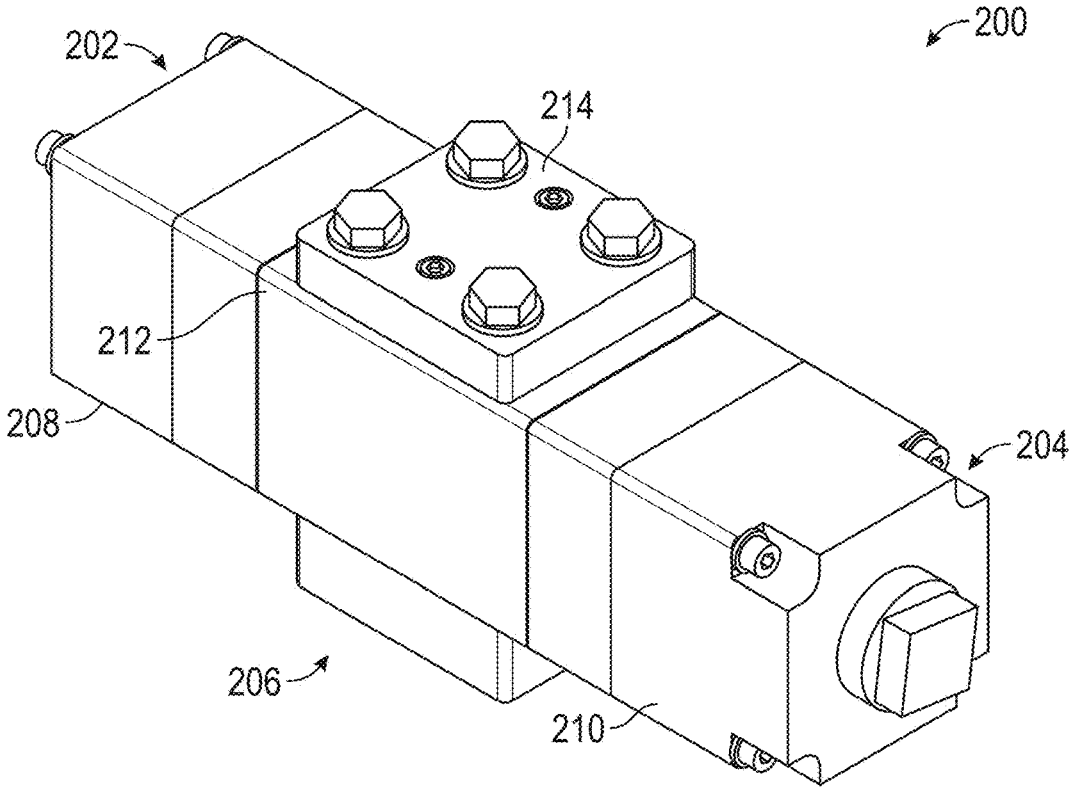
FIG. 2A illustrates a top perspective view of an implementation of a linear shear flow valve according to various implementations.

FIG. 2A illustrates an implementation of a linear shear flow valve or directional control valve (DCV) 200. The DCV 200 can be a pressure vessel component, in some cases experiencing up to 6,000 psi, used in the fracking process to allow high pressure grease injection for regular maintenance of frack tree components and frack valves. The DCV 200 can function as a hydraulic valve like the plurality of high pressure two-way valves 120 of the manifold 110, which can be connected to the control valves 106, 108 in the frack stack assembly 100 described above. The DCV 200 can include a first end 202, a second end 204, and a valve section 206. The first end 202, second end 204, and the valve section 206 can be coupled together by one or more mechanical fasteners (e.g., bolts). Thus, any of the components of the DCV 200 can be replaceable.

The first end 202 can include a housing 208. The housing 208 can be generally block-shaped. The housing 208 can include one or more planar faces. The second end 204 can include a housing 210. The housing 210 can be generally block-shaped having one or more planar faces. The valve section 206 can include a housing 212. The housing 212 can be generally block-shaped. A first end of the housing 212 can be coupled with the housing 208 of the first end 202. A second end of the housing 212 can be coupled with the housing 210 of the second end 204. The housing 212 can include one or more planar faces. A plate 214 can be coupled with an upper face of the housing 212. The plate 214 can be attached via one or more mechanical fasteners (e.g., bolts, screws, or the like). The housing 208 can be coupled with the housing 212 through one or more mechanical fasteners. The housing 210 can be coupled with the housing 212 through one or more mechanical fasteners. The composition of the DCV 200 can be modular with any of the components of the first end 202, the second end 204 or the valve section 206 being replaceable.

Figure 2B:
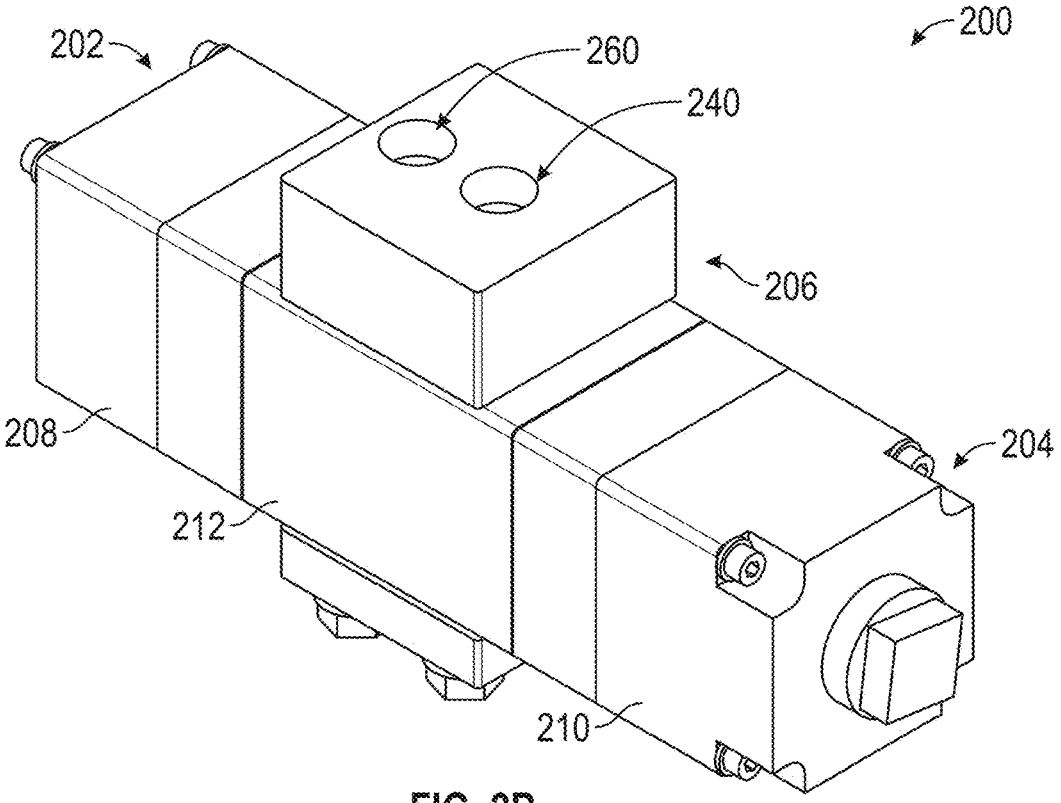
FIG. 2B illustrates a bottom perspective view of the linear shear flow valve shown in FIG. 2A.
Figure 3A:
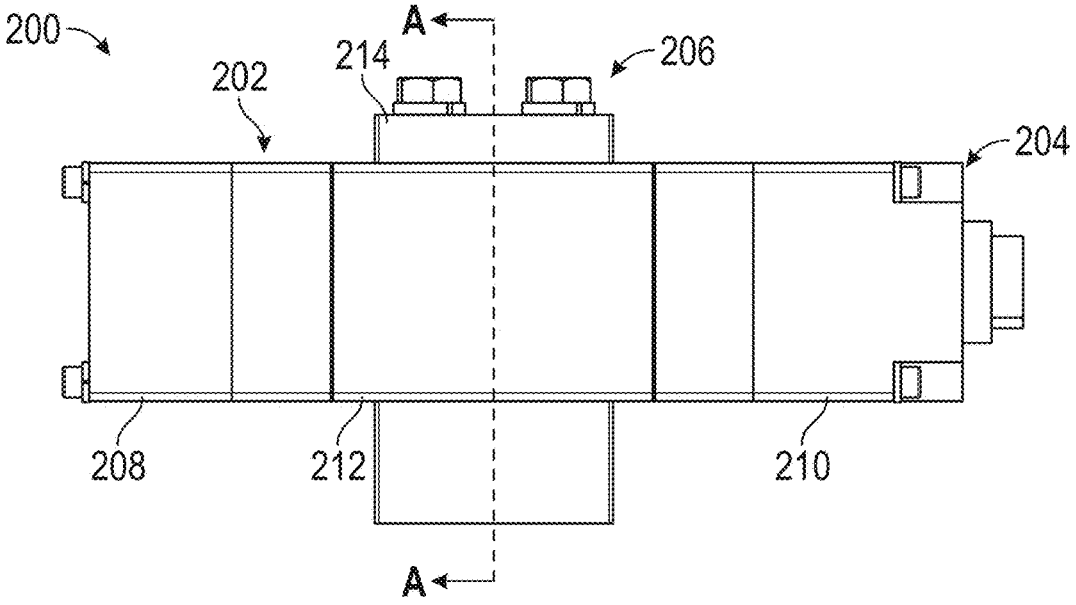
FIG. 3A illustrates a front view of the linear shear flow valve shown in FIGS. 2A-2B.
Figure 3B:
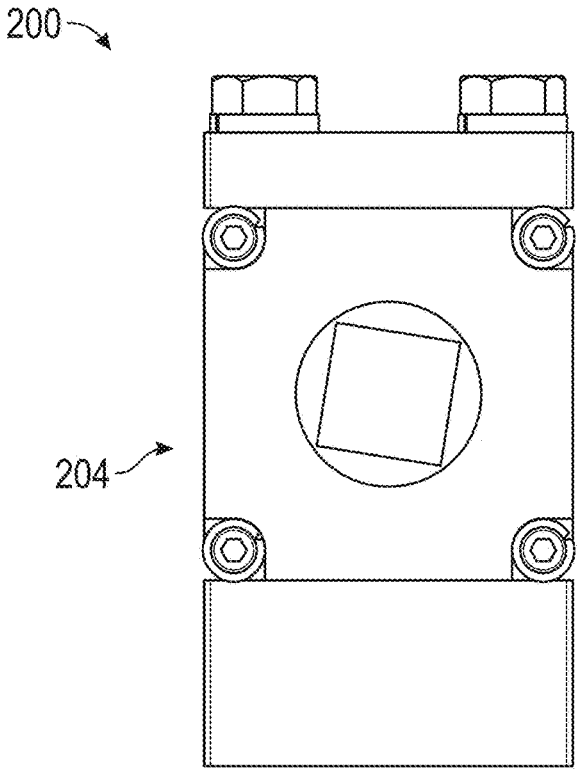
FIG. 3B illustrates an end view of the linear shear flow valve shown in FIGS. 2A-3A.

FIG. 2B illustrates a lower face of the valve section 206. The lower face can be opposite the plate 214. The DCV 200 can include a supply port 240. The supply port 240 can receive a supply of lubrication fluid under pressure. The DCV 200 can include an outlet port 260. The outlet port 260 can alternatively function as a supply port or return port for the lubricant supply depending on the configuration of the DCV 200. The supply port 240 and outlet port 260 can be located in the lower face of the valve section 206. FIG. 3A illustrates a front view of the DCV 200, and FIG. 3B illustrates an end view of the DCV 200 described above.

Figure 4B:
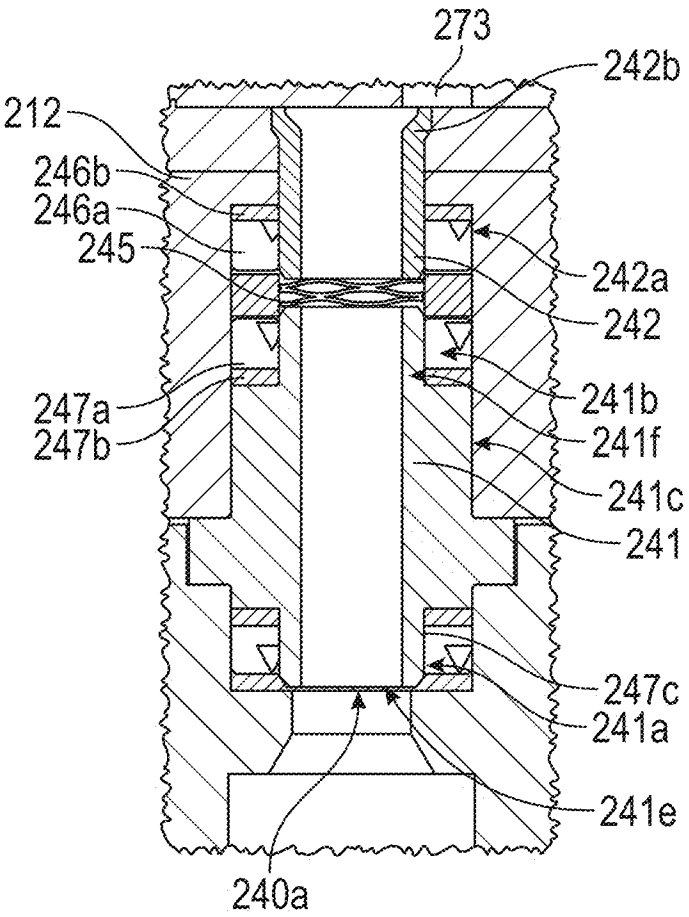
FIG. 4B illustrates a detail of a seal ring of the linear shear flow valve.
Figure 4A:
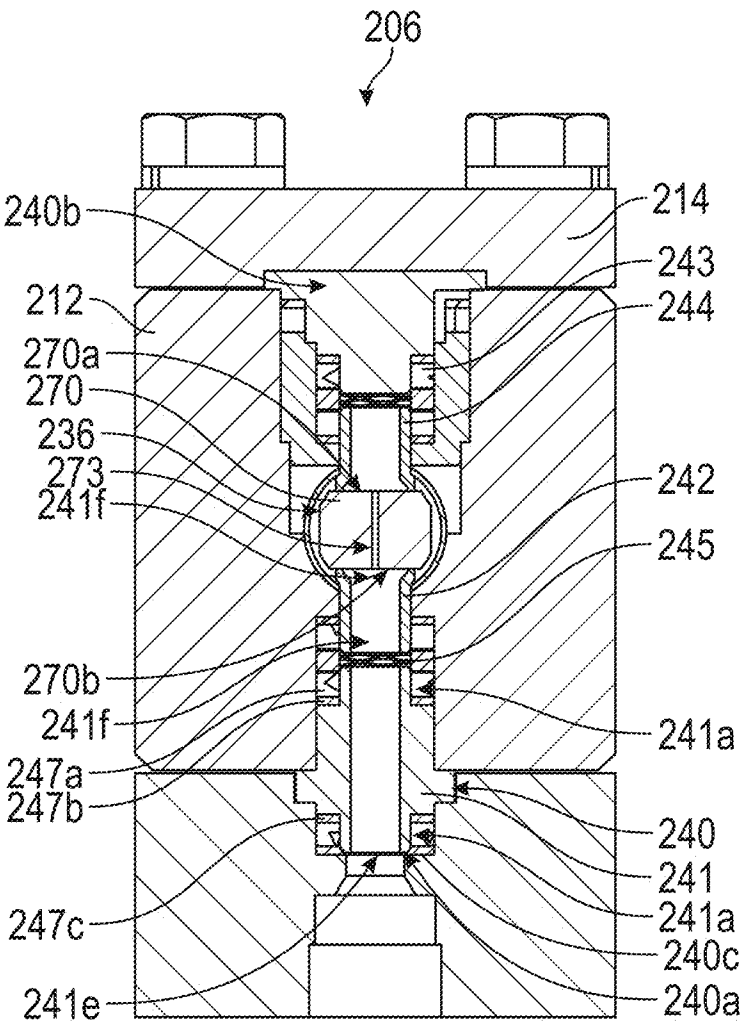
FIG. 4A illustrates a section view taken along the line A-A in FIG. 3A.
Figure 4C:
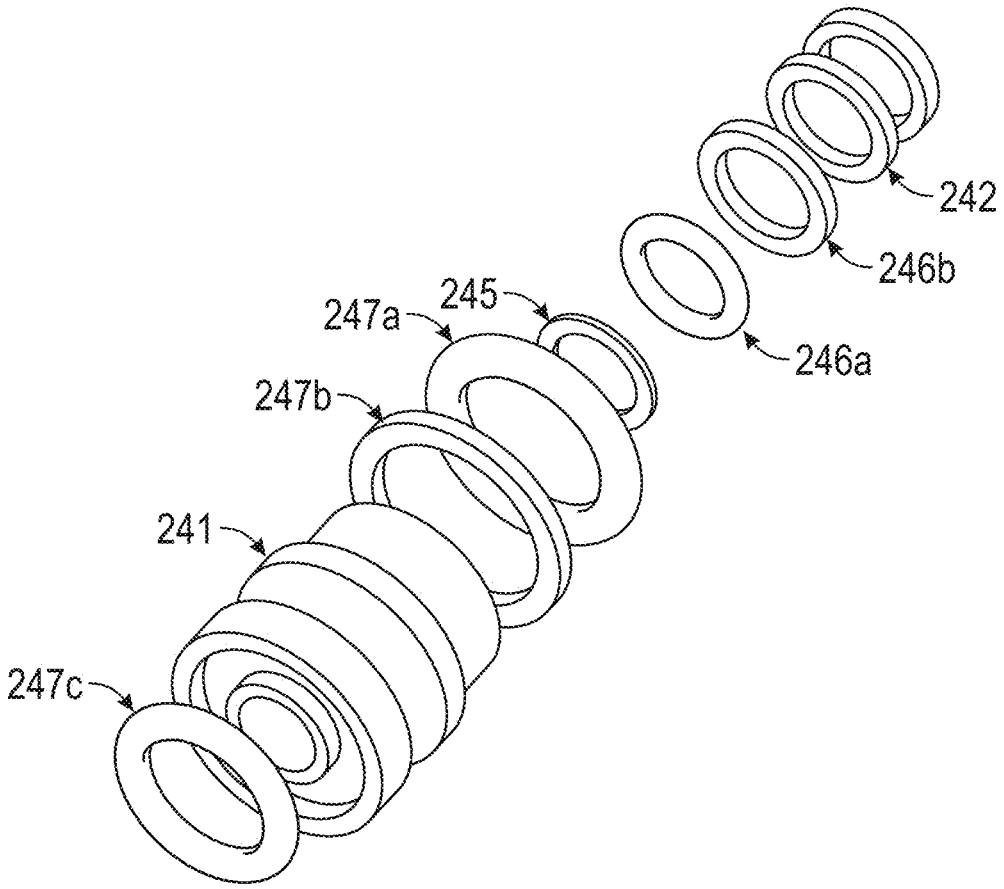
FIG. 4C illustrates an exploded view of a port assembly of the linear shear grease valve of FIGS. 2A-4B for 6,000 psi applications.

FIGS. 4A-4C show further detail of the DCV 200. The supply port 240 can include a first ring holder 241. The first ring holder 241 can include a generally cylindrical structure with a central aperture extending therethrough. A first end 241*e* of the first ring holder 241 can include a cylindrical portion with an outer surface. The outer surface of the cylindrical portion of the first ring holder 241 can include one or more annular grooves. A first annular groove 241*a* can include an O-ring 247*a* and/or a backup ring 247*b*. In some implementations, the backup ring 247*b* can comprise a thermoplastic such as Delrin for low friction, high stiffness, high strength, and wide operating temperature range (e.g., −40° C. to 120° C.). A second annular groove 241*b* can include an O-ring 247*c* to form a radial seal (e.g., with external plate, like plate 214). The first end 241*e* of the first ring holder 241 can further include a lip 241*c*. The lip 241*c* can extend around a circumference of the cylindrical portion.

A second end 241*f* of the first ring holder 241 can include a cylindrical portion with an outer surface. The second end 241*f* of the first ring holder 241 can have a similar and/or smaller diameter than the first end 241*e*. The second end 241*f* of the first ring holder 241 can include a recess (e.g., circular recess) for receiving a first seal ring 242.

The first seal ring 242 can be generally cylindrical with an aperture extending therethrough. An outer surface of a first end 241*e* of the first seal ring 242 can include an annular groove 242*a*. The annular groove 242*a* can contain an O-ring 246*a* and/or a spacer 246*b*. The first seal ring 242 can be installed within the recess in the second end 241*f* of the first ring holder 241. The O-ring 246*a* can provide a seal between the first seal ring 242 and an inner surface of the recess of the second end 241*f* of the first ring holder 241.

The first seal ring 242 can include a lower lip 242*b*. The lower lip 242*b* can be annular and extend around the aperture of the first seal ring 242. The lower lip 242*b* can include a planar surface for providing a metal-to-metal seal. The planar surface can be a lapped and/or polished surface to affect a metal-to-metal seal. The supply port 240 can also include a biasing member, such as a wave spring 245. The wave spring 245 can be positioned within the recess of the first ring holder 241. The wave spring 245 can be positioned between the first seal ring 242 and an inner ledge within the first ring holder 241.

The DCV 200 can include a slide, such as sliding member 270. In some implementations, the sliding member 270 can be cylindrical. The sliding member 270 can be located within an interior space 236 of the housing 212. The sliding member 270 can include passage 273. The passage 273 can extend from an upper face 270*a* to a lower face 270*b* of the sliding member 270. The sliding member 270 can be movable along a linear axis within the interior space 236. The sliding member 270 can further include a first aperture 275 into an inner passage 274. The first aperture 275 and the inner passage 274 can be unconnected and separate from the passage 273.

The housing 212 can include a first opening 240*a* into the interior space 236. The first ring holder 241 can be disposed within the first opening 240*a*. The O-rings 247*a*, 247*c* can seal against inner walls of the first opening 240*a*. The first opening 240*a* can include an inner ledge 240*c*. The lip 241*c* can abut the inner ledge 240*c* to position the first ring holder 241 within the first opening 240*a*. Alternatively, an expanding ring can be used to hold the first ring holder 241 within the first opening 240*a*.

The first end 241*e* of the first ring holder 241 can be disposed within the first opening 240*a*. The second end 241*f* of the first ring holder 241 can at least partially extend from the first opening 240*a*. The first seal ring 242 can be disposed within the recess in the first ring holder 241. The lower lip 242*b* can contact the lower face 270*b* of a sliding member 270. The lower face 270*b* can include a lapped surface. The lower lip 242*b* can seal against the lower face 270*b* in a metal-to-metal seal, even during sliding contact between the first seal ring 242 and the sliding member 270. The wave spring 245 can bias the first seal ring 242 towards the lower face 270*b* with a sealing force (e.g., an initial sealing force). As the sliding member 270 is moved along the linear axis, the first seal ring 242 can be aligned with the passage 273 or the first aperture 275, depending on a position thereof, as described further below.

The supply port 240 can further include a second ring holder 243, a second seal ring 244, along the O-rings, spacers, and wave springs. The second ring holder 243 and the second seal ring 244 can be structured as the first ring holder 241 and first seal ring 242. The housing 212 can include a second opening 240*b*. The second ring holder 243 can be disposed in the second opening 240*b* and the second seal ring 244 can be installed within the second ring holder 243. The second seal ring 244 can seal against the upper face 270*a* of the sliding member 270. The first and second openings 240*a*, 240*b* can be aligned along a single axis. The components of the supply port 240 can be aligned align the single axis.

Figure 5:
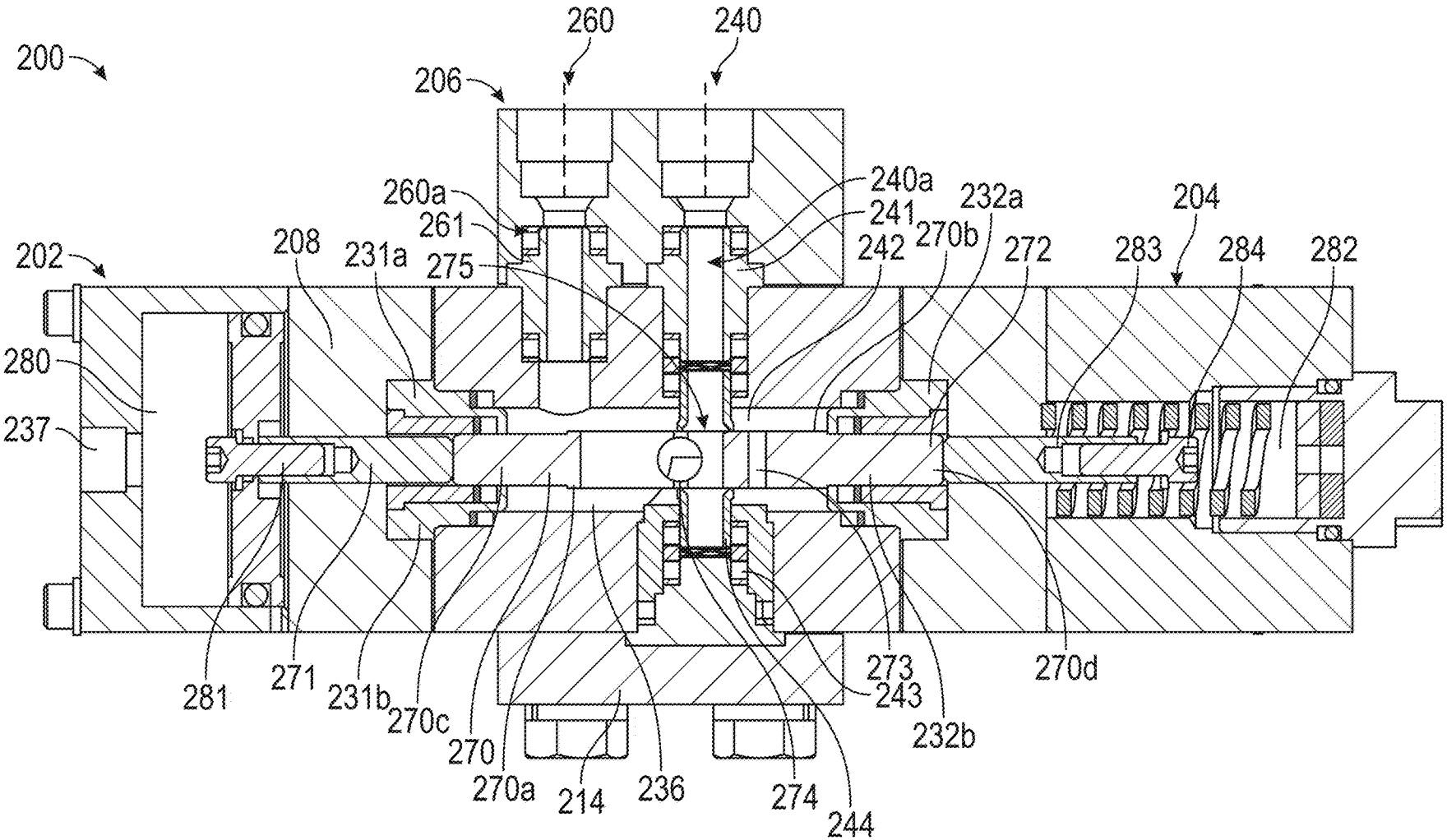
FIG. 5 illustrates a section view of the linear shear flow valve in a first configuration.

As shown in FIG. 5, the outlet port 260 can include a first ring holder 261. The first ring holder 261 of the outlet port 260 can be structured similar to the first ring holder 241. The first ring holder 261 can be located within a third opening 260*a* within the housing 212. The third opening 260*a* can be structured similar to the first opening 240*a*. The plate 214 can block the second opening 240*b*. The plate 214 can be removably coupled with an upper face of the housing 212. A lower face of the housing 212 (opposite the upper face) can be configured to couple with a manifold (shown in FIGS. 7A-8). The manifold can include passages for communication with the supply port 240 and/or outlet port 260.

The sliding member 270 can be located within the interior space 236. The sliding member 270 can be moveable along a first axis (e.g., left and right, as shown in FIG. 5). The sliding member 270 can include a first side including the inner passage 274. The inner passage 274 can be in communication with the first aperture 275. The first aperture 275 can extend through the upper face 270*a* and the lower face 270*b* of the sliding member 270. The inner passage 274 can be in communication (e.g., fluid communication) with interior space 236. The interior space 236 can be in further communication with the outlet port 260.

Figure 6:
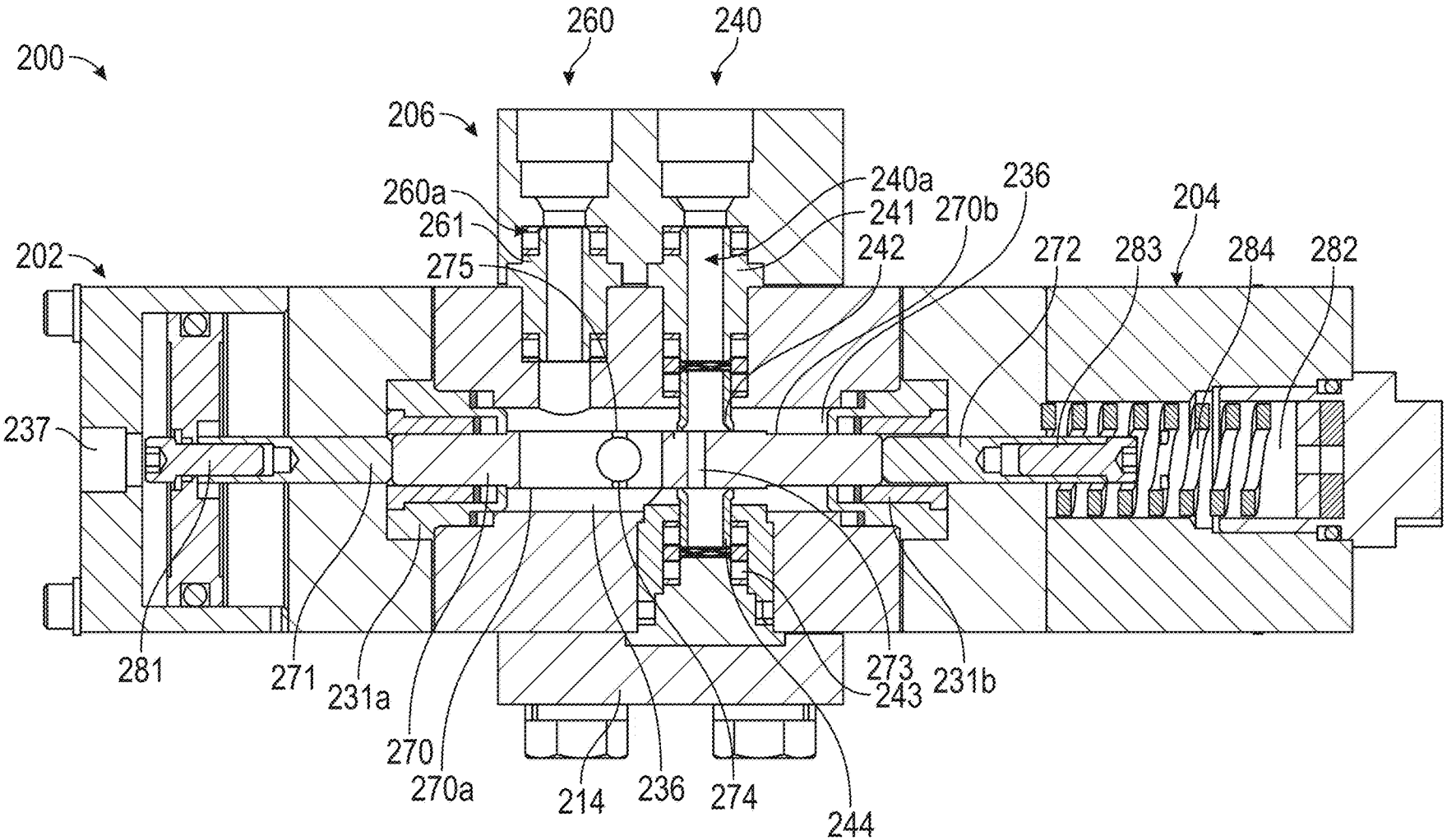
FIG. 6 illustrates the linear shear flow valve in a blocked configuration.
Figure 9A:
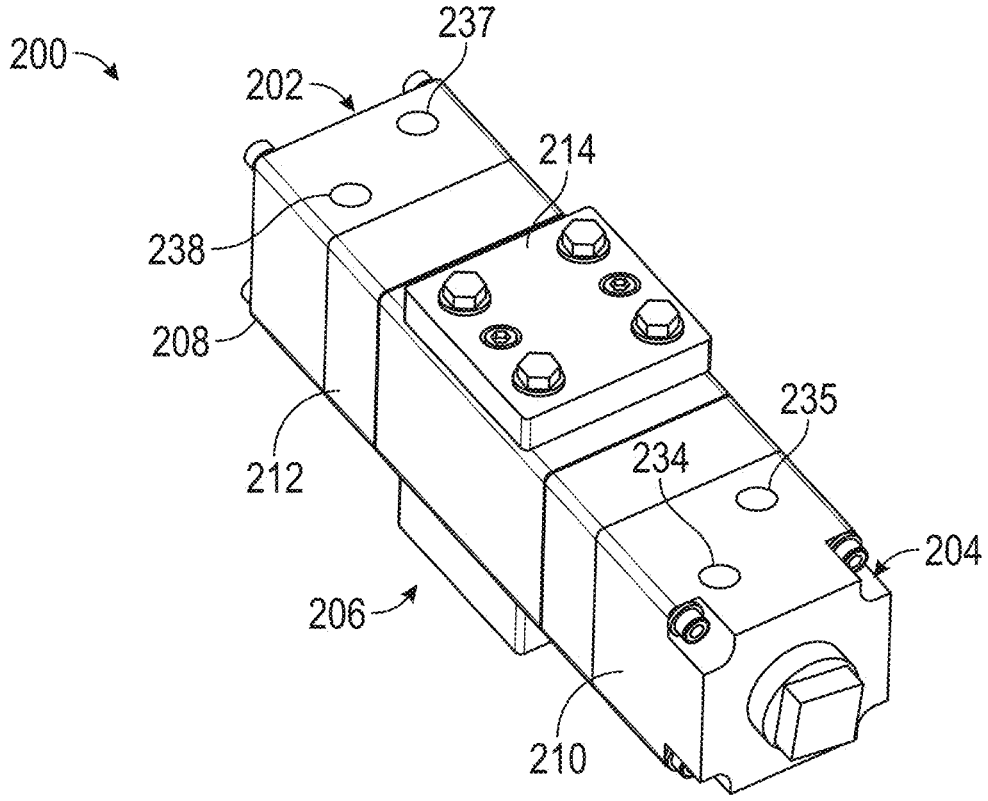
FIGS. 9A-9B illustrate the linear shear flow valve having two sets of pilot holes.
Figure 9B:
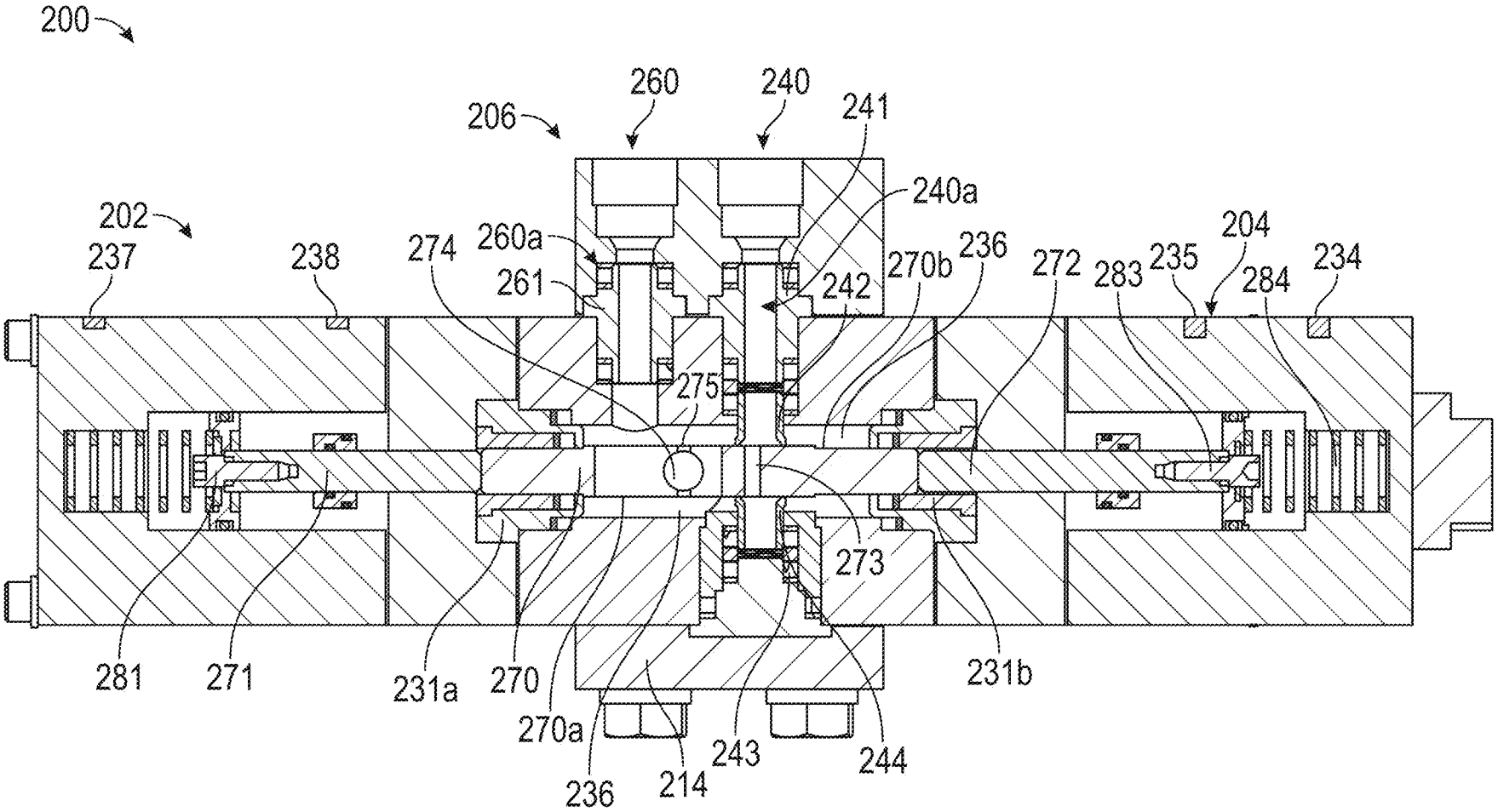

The DCV 200 can includes a first end 202 with a first piston 281 coupled with the sliding member 270 and a second end 204 with a second piston 283 coupled with the second end of the sliding member 270. The first end 202 can include first pilot holes 237 for connecting with a pressure source (e.g., compressed air) for moving the first piston 281 within an air chamber 280 in the first end 202. The second end 204 can include a biasing member, such as a spring 284. In the illustrated embodiment, the spring 284 is a helical spring. The spring 284 can be coupled with the second end 270*d* of the sliding member 270 through a second shaft 272 and/or the second piston 283 for biasing the position of the sliding member 270 into any of the first or blocking configurations, depending on the configuration of the spring 284. As shown in FIG. 6, the spring 284 can bias the sliding member 270 into the blocked configuration. In some implementations, as shown in FIGS. 9A and 9B, the air chamber 280 to move the first piston 281 can be replaced with a hydraulic actuator. In said implementation, the first end 202 can include first and second pilot holes 237, 238 for connecting with a pressure source for moving the first piston 281 within a chamber in the first end 202. In another implementation, the spring 284 can be replaced with an air chamber similar to the air chamber 280 in contact in first piston 281 illustrated in FIGS. 5 and 6. Additionally or alternatively, as illustrated in FIGS. 9A and 9B, the air chamber 280 and spring 284 can be substituted for two hydraulically actuated first and second pistons 281, 283. In said implementation, the first end 202 can include first and second pilot holes 237, 238 for connecting with a pressure source for moving the first piston 281 within a chamber in the first end 202 and first and the second end 204 can include second pilot holes 234, 235 for connecting with a pressure source for moving the second piston 283 within a chamber in the second end 204. In some implementations, the first piston 281 and/or second piston 283 can be remotely controlled using a pilot solenoid valve to control blocked/unblocked functionality.

The first end 270*c* of the sliding member 270 can be coupled with a first shaft 271. The first shaft 271 can extend into the air chamber 280 in the first end 202. The air chamber 280 can contain the piston 281. The first shaft 271 can extend through guides 231*a*, 231*b*. The guides 231*a*, 231*b* can be located in the housing of the first end 202. The guides 231*a*, 231*b* can include one or more O-rings for hydraulically isolating the interior space 236 between the first end 202 and the valve section 206. One or more piston guides 231*a* can separate and seal the chamber of the first piston 281 from an interior space of the valve section 206.

The second end 270*d* of the sliding member 270 opposite the first end 270*c* can be coupled with a second shaft 272. The second shaft 272 can extend into a chamber 282 in the second end 204. The chamber 282 can contain the second piston 283. The second piston 283 can be coupled with the second shaft 272. The second shaft 272 can extend through one or more piston guides 232*a*, 232*b*. The piston guides 232*a*, 232*b* can include one or more O-rings for isolating the interior space 236 from the air chamber 280. The second piston guide, 232*a*, 232*b* can separate and seal the chamber 282 of the second piston 283 from the interior of the valve section 206.

FIG. 5 illustrates the DCV 200 in a lubricating or open configuration. In the lubricating or open configuration, the first aperture 275 of the sliding member 270 is aligned with the supply port 240. In this configuration, the DCV 200 forms a flow path for the lubricant supply fluid to flow through the supply port 240, into the inner passage 274, and out through the outlet port 260. The outlet port 260 can be hydraulically coupled with a fracking valve. Routing the lubricant supply fluid through the outlet port 260 can provide a lubricant to the fracking valve to force out any debris accumulated in the cavity.

One aspect of the DCV 200 is the use of the seal rings in pairs (e.g., first and second seal rings 242, 244). By aligning the pairs of seal rings on opposite sides of the sliding member 270, the pressure from the lubricant supply fluid is applied on opposite sides of the sliding member 270. Thus, the pressure from the lubricant fluid can be equal on the upper and lower faces 270*a*, 270*b* of the sliding member 270. In some implementations, the pressure from the lubricant is about 2,000 psi to 10,000 psi, between about 3,000 psi to 9,000 psi, between about 3,500 psi to 8,500 psi, between about 4,000 psi to 8,000 psi, between about 4,500 psi to 7,500 psi, or about between 5,000 psi to 7,000 psi. An advantage of this arrangement is that the pairs of seal rings can help maintain the sliding member 270 centered within the valve section 206. The pairs of seal rings also help maintain the metal-to-metal seals between the seal rings and the upper and lower faces of the sliding member 270. The lubricant pressure can increase the sealing force between the seal rings and the sliding member to maintain the metal-to-metal seal beyond the force provided by the wave springs (e.g., wave spring 245). The first and second seal rings 242, 244 can prevent the lubrication fluid from entering interior space 236 and the outlet port 260 in the blocked configuration.

FIG. 6 illustrates a blocked configuration of the sliding member 270. In the block configuration the passage 273 is aligned with the supply port 240. Thus, the lubricant supply fluid has no path to proceed forward. In some implementations, the flow of the lubricant can be reversed such that the lubricant flows through the outlet port 260. The first and second scal rings 242, 244 can prevent the lubrication fluid from entering the supply port 240.

Figure 7A:
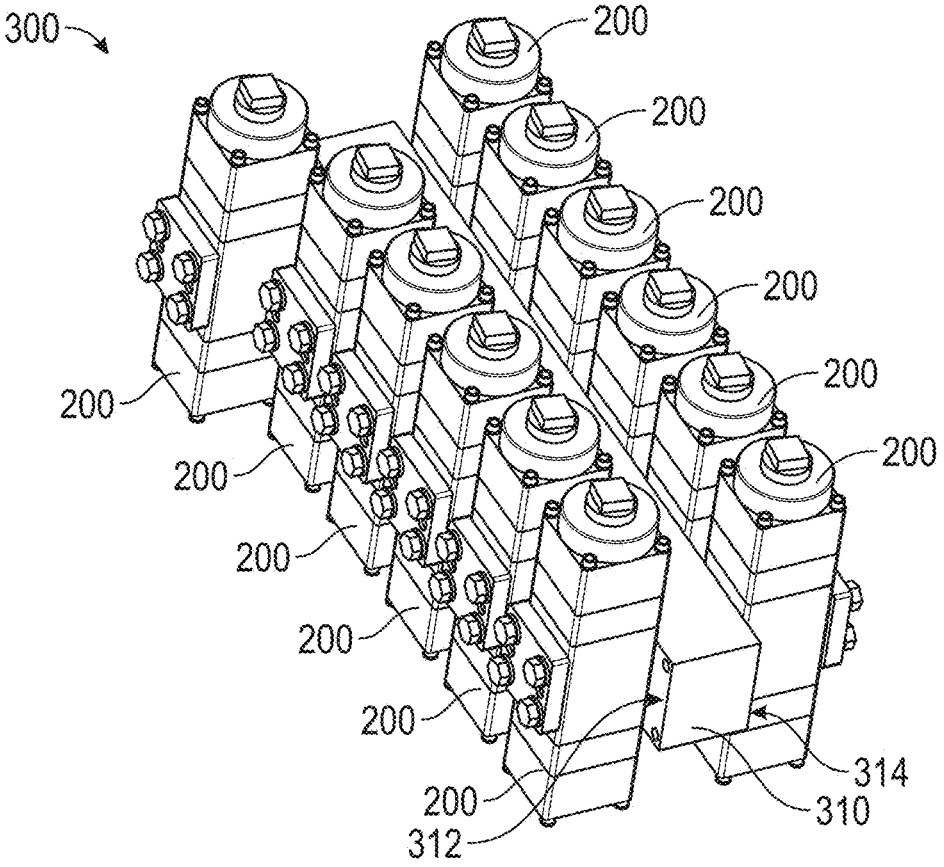
FIG. 7A illustrates a modular assembly of a plurality of linear shear flow valves on a common manifold.
Figure 7B:
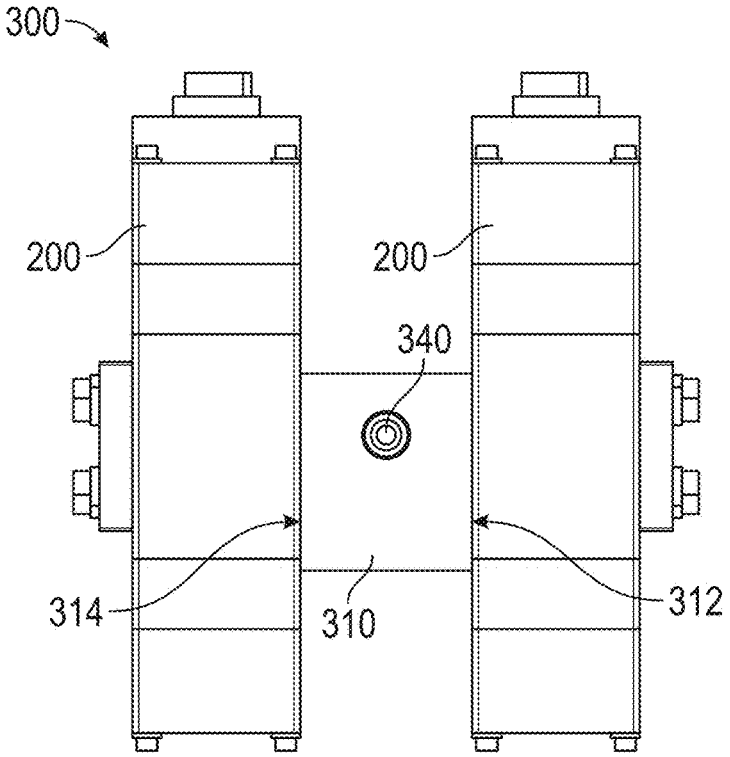
FIG. 7B illustrates a perspective side view of the modular assembly of FIG. 7A.
Figure 7C:
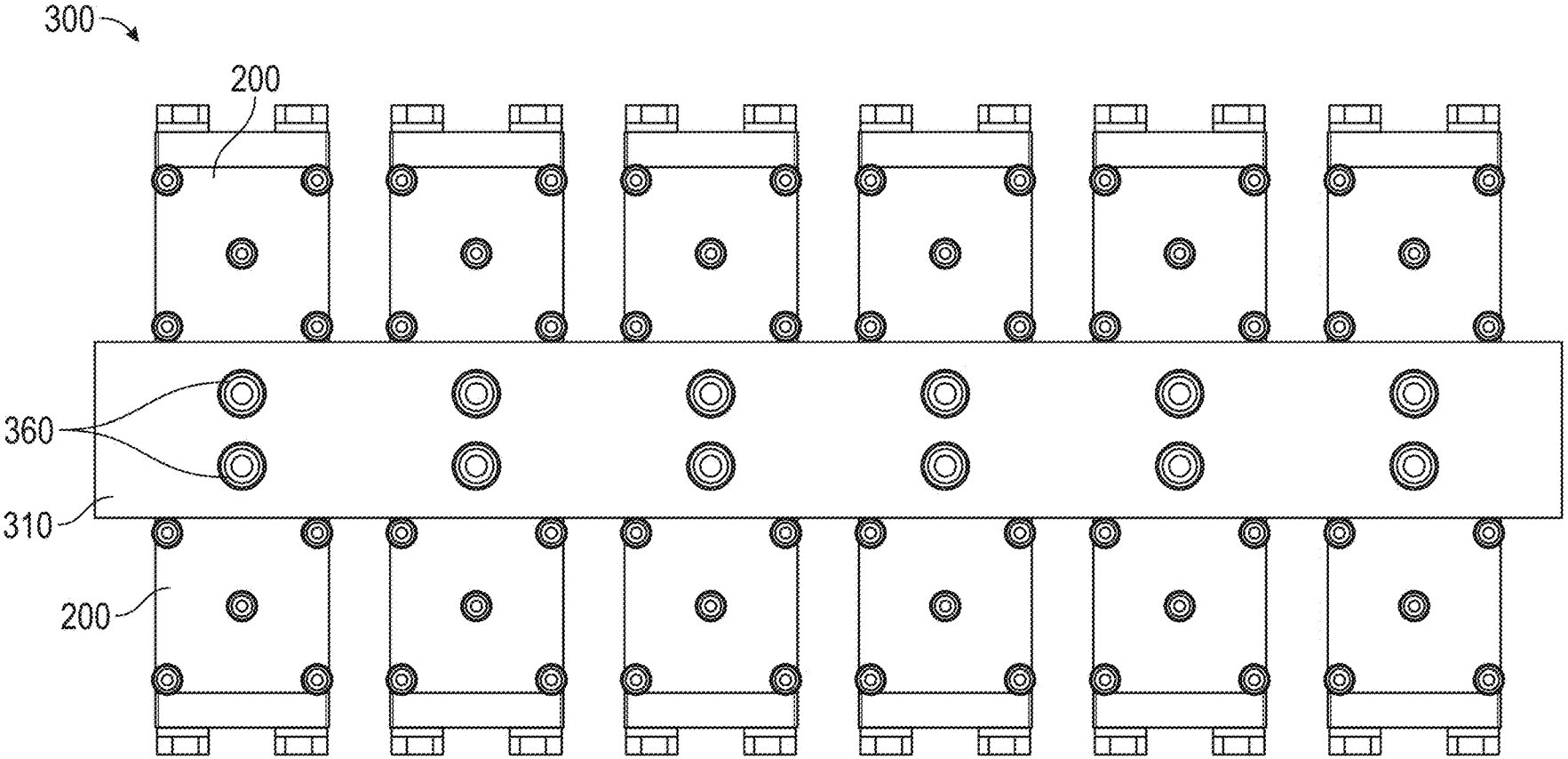
FIG. 7C illustrates a perspective bottom view of the modular assembly of FIGS. 7A and 7B demonstrating a plurality of output lubricant supply conduits.
Figure 8:
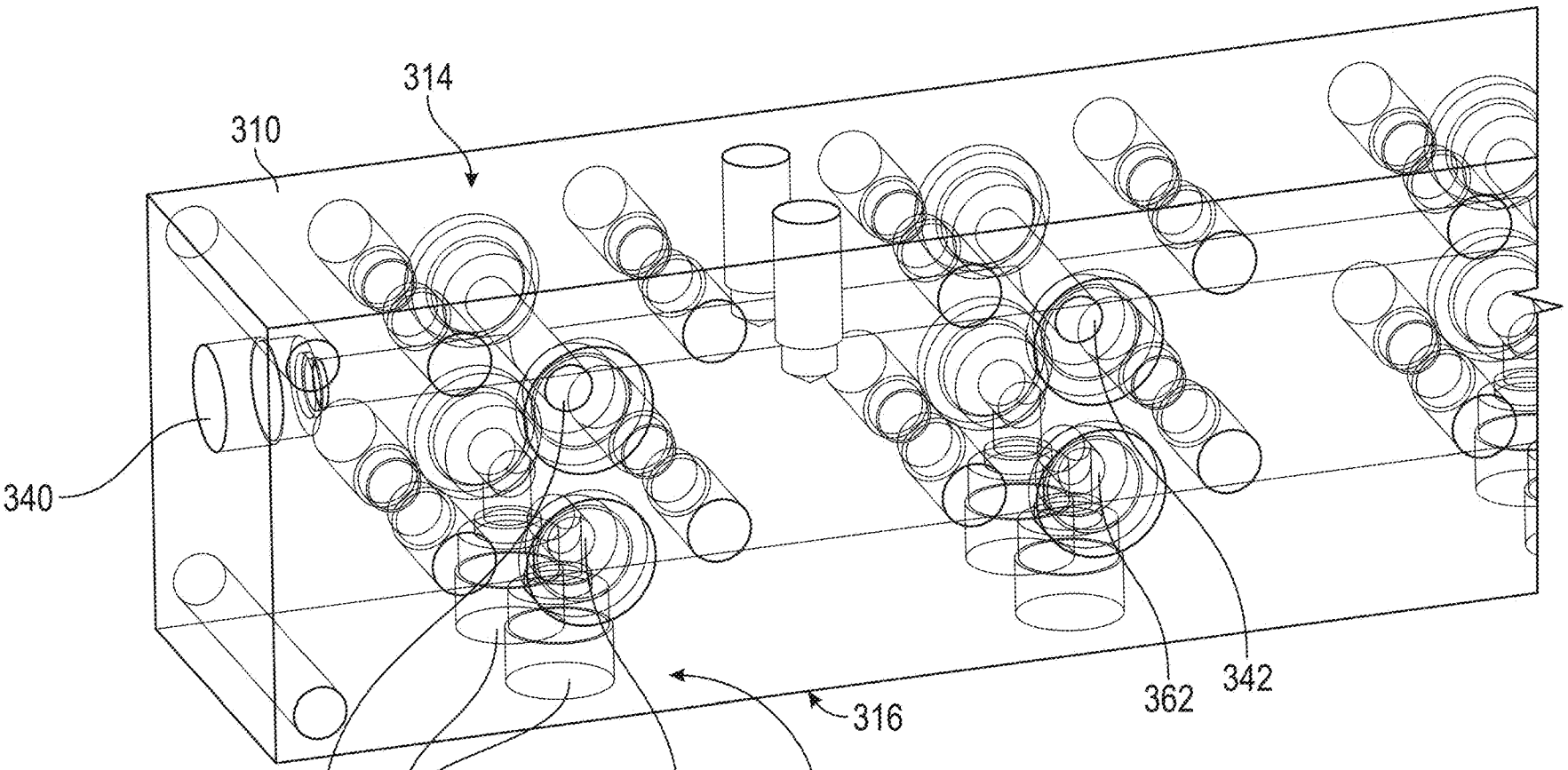
FIG. 8 illustrates a schematic internal perspective view of the common manifold.

FIGS. 7A-7C illustrates a manifold assembly 300 including several implementations of the DCV 200 mounted on a manifold 310. FIG. 8 illustrates a schematic internal perspective view of the manifold 310. The manifold 310 can be an implementation of the manifold 110 in the frack stack assembly 100. The lower face of the housing 212 (e.g., opposite the plate 214) of the DCV 200 can be mounted on the first face 312 and/or second face 314 opposite first face 312 of the of the manifold 310. The DCV 200 can be coupled using mechanical fasteners.

The manifold 310 can include a main lubricant supply input conduit 340. The main lubricant supply input conduit 340 can be in communication with the supply port 240 of the DCV 200 for providing the lubrication supply fluid thereto. The manifold 310 can include apertures 342 on the first face 312 and/or the second face 314 that connects with the main lubricant supply input conduit 340 and align with the supply ports 240 of the DCV 200. The manifold 310 can also include a plurality of lubricant output conduits 360. The plurality of lubricant output conduits 360 can be in communication with the outlet port 260 of the DCV 200 for receiving the lubricant supply therefrom. The manifold 310 can include apertures 362 on the third face 316 that connect with the plurality of lubricant output conduits 360 and align with the outlet port 260 of the DCV 200.

The DCV 200 can be coupled with the manifold 310 using mechanical fasteners. The DCV 200 components can be aligned with the first ends 202 on one side of the manifold 310 and the second ends 204 on the other. Adjacent faces of the DCV 200 components can be aligned in a compact arrangement.

Coupling the DCV 200 with the manifold 310 can include aligning the ports with the respective conduits. Conduits for coupling with the various supply ports and/or outlet ports of the DCV 200 can couple with the manifold 310. The DCV 200 can be removably coupled with the manifold 310. Accordingly, any of the DCV 200 components can be easily replaced without re-plumbing the conduits of the manifold 310. In some implementations, including the illustrated implementation, the DCV 200 can be directly mountable to a manifold 310 without additional modification or adapter plates. Accordingly, in some implementations, the several DCV 200 can be mounted in a compact, modular manner with the manifold 310. According to another implementation, the manifold assembly 300 allows for a more compact spacing and smaller manifold assembly for the same pressure and flow rate as previous manifold designs. In certain embodiments, the DCV 200 can include common parts, such as the rings and ring holders. This, as well as the modular component design allows case of field modification, repair, and/or maintenance.

Figure 10A:
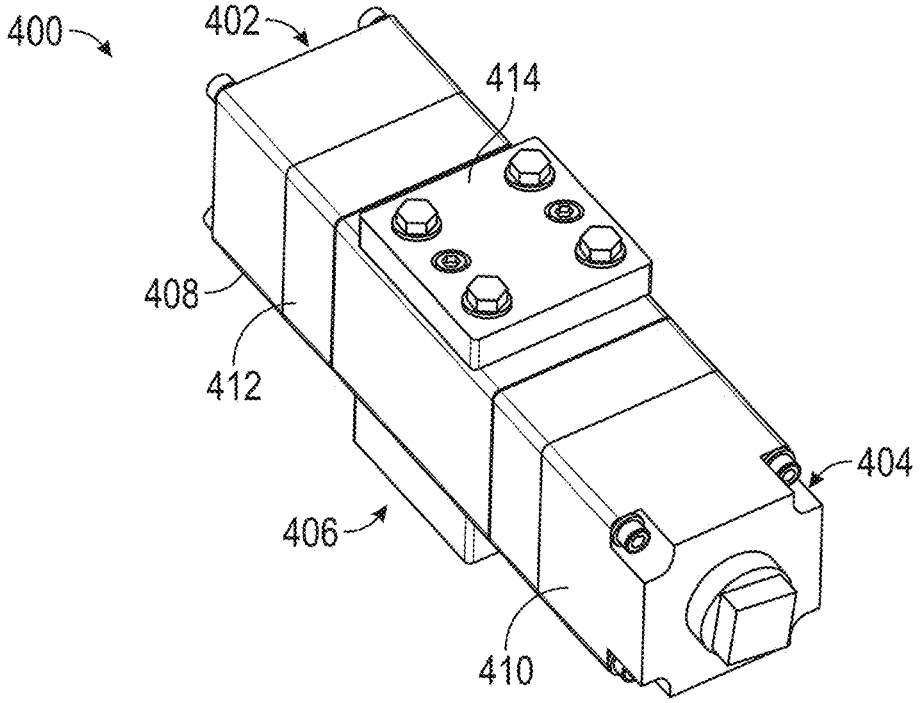
FIGS. 10A-10B illustrate another implementation of a linear shear flow valve according to various implementations.
Figure 10B:
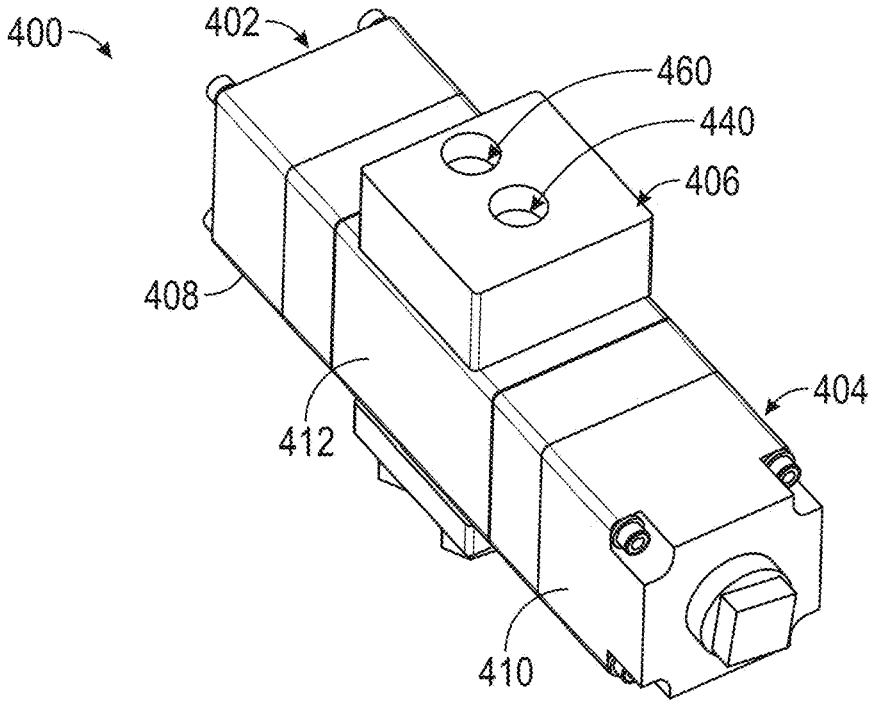
Figure 10C:
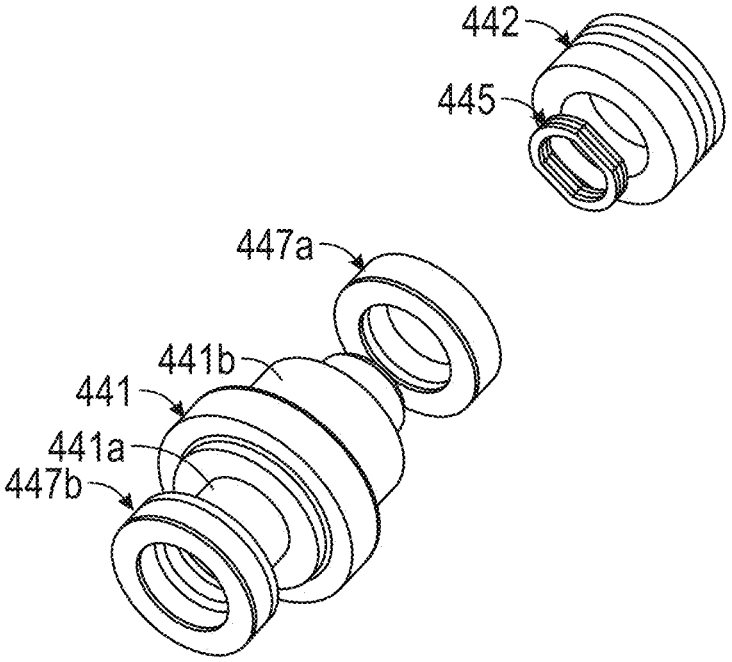
FIGS. 10C-10D illustrate illustrates exploded views of a port assembly of the linear shear grease valve of FIGS. 10A-1B rated for 20,000 psi applications.
Figure 10D:
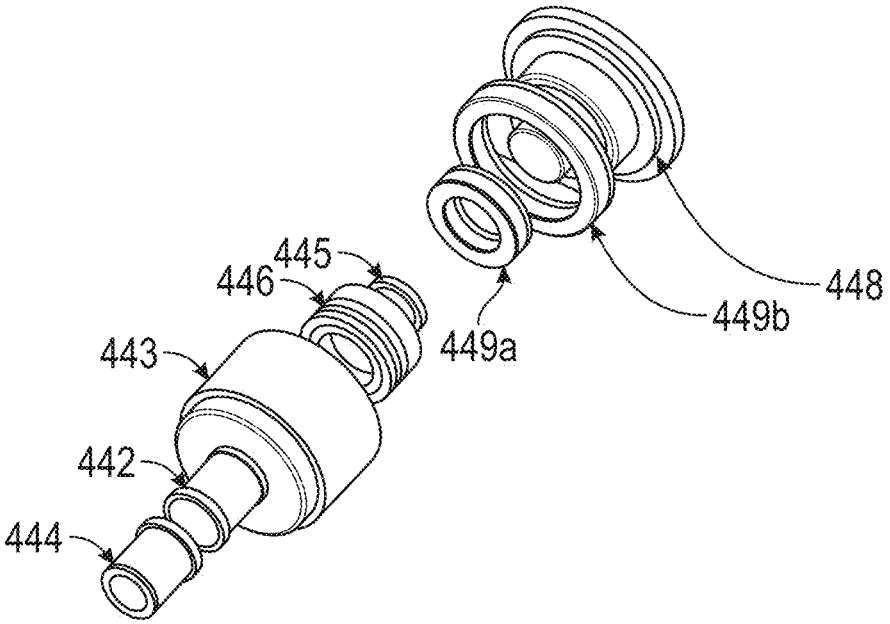

FIGS. 10A-10B illustrate another implementation of a linear shear flow valve 400. The linear shear flow valve 400 can be structured similar to the DCV 200, with the differences noted below. The linear shear flow valve 400 can be a pressure vessel component, in some cases experiencing up to 20,000 psi, used in the fracking process to allow high pressure grease injection of regular maintenance of frack tree components and manifold. Instead of including first ring holder 241, first seal ring 242, second ring holder 243, second seal ring 244, and first ring holder 261 as described above, the linear shear flow valve 400 can include a different arrangement configured to experience higher pressures. For example, a supply port 440 of the linear shear flow valve 400 can include first ring holder 441 and bidirectional seal 442 as shown in FIGS. 10C and 10D. For example, the bidirectional seal 410 can allow the lubricant supply fluid to flow both in and/or out of the supply port 440 depending on the flow of the lubricant supply fluid and/or the position of the sliding member 470. However, other structures, which provide the ability to seal and/or prevent flow in and/or out of the supply port 440 could also be used. The first ring holder 441 can include a generally cylindrical structure with a central aperture extending therethrough. The first ring holder 441 can be sized to form a complete seal within the opening 440*a*. A first end 441*e* of the first ring holder 441 can include a cylindrical portion with an outer surface. The outer surface of the cylindrical portion of the first ring holder 441 can include one or more annular grooves and/or one or more integrated back-up rings. A first annular groove 441*a* can include a ring 447*a*. The ring 447*a* can comprise a thermoplastic such as Delrin for low friction, high stiffness, high strength, and wide operating temperature range (e.g., −40° C. to 120° C.). A second annular groove 441*b* can include a ring 447*b* to form a radial seal (e.g., with external plate, like plate 414).

A second end 441*f* of the first ring holder 441 can include a cylindrical portion with an outer surface. The second end 441*f* of the first ring holder 441 can have a similar and/or smaller diameter than the first end 441*e*. The second end 441*f* of the first ring holder 441 can include a recess (e.g., circular recess) for receiving the bidirectional seal 442. The bidirectional seal 442 can be generally cylindrical with an aperture extending therethrough. Additionally, the bidirectional seal 442 can be a bi-directional seal to preclude the flow of the lubricant from multiple directions. The bidirectional seal 442 can include a planar surface for providing a metal-to-metal seal. The planar surface can be a lapped and/or polished surface to affect a metal-to-metal seal. The supply port 440 can also include a wave spring 445. The wave spring 445 can be positioned within the recess of the first ring holder 441. The wave spring 445 can be positioned between the bidirectional seal 442 and an inner ledge within the first ring holder 441.

Figure 11:
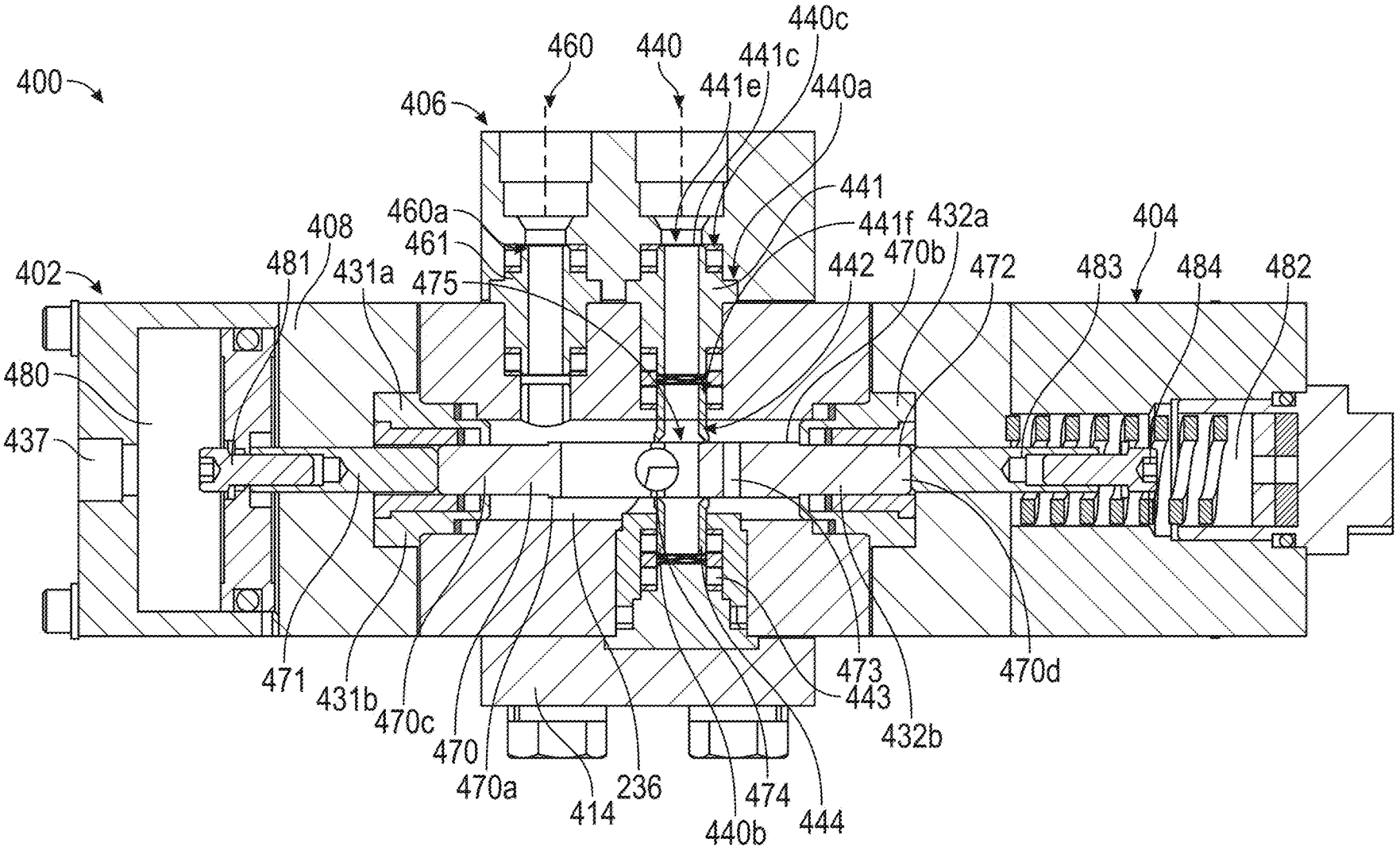
FIG. 11 illustrates a schematic cross-sectional view of the linear shear flow valve of FIGS. 10A-10B.

As illustrated in FIG. 11, the housing 412 can include the first opening 440*a* into the interior space 436. The first ring holder 441 can be disposed within the first opening 440*a*. The ring 447*b* can seal against inner walls of the first opening 440*a*. The first opening 440*a* can include an inner ledge 440*c*. The lip 441*c* can abut the inner ledge 440*c* to position the first ring holder 441 within the first opening 440*a*. Alternatively, an expanding ring can be used to hold the first ring holder 441 within the first opening 440*a*.

The first end 441*e* of the first ring holder 441 can be disposed within the first opening 440*a*. The second end 441*f* of the first ring holder 441 can at least partially extend from the first opening 440*a*. The bidirectional seal 442 can be disposed within the recess in the first ring holder 441. The bidirectional seal 442 can contact the lower face 470*b* of a sliding member 470. The lower face 470*b* can include a lapped surface. The bidirectional seal 442 can seal against the lower face 470*b* in a metal-to-metal seal, even during sliding contact between the bidirectional seal 442 and the sliding member 470. The wave spring 445 can bias the bidirectional seal 442 towards the lower face 470*b* with a sealing force (e.g., an initial scaling force). As the sliding member 470 is moved along the linear axis, the bidirectional seal 442 can be aligned with the passage 473 or the first aperture 475, depending on a position thereof, as described further below.

The supply port 440 can further include a second ring holder 443, one or more seal rings 444, a bidirectional seal 446, along with the rings and wave springs. The second ring holder 443 and the bidirectional seal 446 can be structured similar to the first ring holder 441 and the bidirectional seal 442. The housing 412 can include a second aperture 440*b*. The second ring holder 443 can be disposed in the second openings 440*b* and the seal rings 444 can be installed within the second ring holder 443. The one or more seal rings 444 can seal against the upper face 470*a* of the sliding member 470. The first and second openings 440*a*, 440*b* can be aligned along a single axis. The components of the supply port 440 can be aligned align the single axis. Additionally, a secondary ring holder 448 can be further connected to the bidirectional seal 446 opposite the second ring holder 443. The secondary ring holder 448 can include a first annular groove 448*a* in which is set a ring 449*a*. The ring 449*a* can comprise a thermoplastic such as Delrin for low friction, high stiffness, high strength, and wide operating temperature range (e.g., −40° C. to 120° C.). A second annular groove 448*b* can include a ring 449*b* to form a radial seal (e.g., with external plate, like plate 414).

The outlet port 460 can include a first ring holder 461. The first ring holder 461 of the outlet port 460 can be structured similar to the first ring holder 441. The first ring holder 461 can be located within a third opening 460*a* within the housing 412. The third opening 460*a* can be structured as the first opening 440*a*.

The plate 414 can block the second aperture 440*b*. The plate 414 can be removable coupled with an upper face of the housing 412. A lower face of the housing 412 (opposite the upper face) can be configured to couple with a manifold (not shown). The manifold can include passages for communication with the supply port 440 and/or outlet port 460.

One aspect of the linear shear flow valve 400 is the use of the seal rings and/or bidirectional seals (e.g., bidirectional seal 442 and/or one or more seal rings 444). By aligning the pairs on opposite sides of the sliding member 470, the pressure from the lubricant supply fluid is applied on opposite sides of the sliding member 470. Thus, the pressure from the lubricant fluid can be equal on the upper and lower faces 470*a*, 470*b* of the sliding member 470. In some implementations, the pressure from the lubricant is about 10,000 psi to 25,000 psi, between about 12,500 psi to 22,500 psi, between about 13.00 psi to 22,000 psi, between about 14,000 psi to 21,000 psi, between about 14,500 psi to 20,500 psi, or about between 15,000 psi to 20,000 psi.

SUMMARY

Several illustrative embodiments of hydraulic components have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular embodiment of the inventions disclosed herein. No aspects of this disclosure are essential or indispensable. In many embodiments, the devices, systems, and methods may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of hydraulic components and related methods have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

What is claimed is:

1. A fracking stack assembly coupled with a wellhead, the fracking stack assembly comprising:

a hydraulic pump and a motor for powering the hydraulic pump;

at least one lubricant reservoir for providing a flow of pressurized lubricant;

at least one conduit hydraulically coupling the hydraulic pump with the at least one lubricant reservoir, wherein the hydraulic pump pressurizes the flow of pressurized lubricant;

a fracking valve including a cavity within a body of the fracking valve;

a linear shear-flow controller configured to deliver the flow of pressurized lubricant to the fracking valve comprising:

a housing including an interior space;

a supply port receiving the flow of pressurized lubricant and including first and second apertures in the housing, a first ring holder disposed in the first aperture and a first seal ring coupled within the first ring holder, a second ring holder disposed in the second aperture and a second seal ring coupled within the second ring holder;

an outlet port, including a third aperture in the housing, a third ring holder disposed in the third aperture; and a slide having a first end and a second end disposed within the interior space and movable along a linear axis, the slide including a first side and a second side opposite the first side, an inner passage and a center aperture extending through the slide between the first and the second end, the center aperture connected to a through port extending through the slide;

wherein the first side of the slide sealingly engages with the first seal ring, and the second side of the slide sealingly engages with the second seal ring, the slide slideable along the linear axis between blocked and open positions;

wherein in the blocked position of the slide, the center aperture is aligned between the supply port and outlet port and aligned along with the first and second seal rings, wherein the pressurized lubricant flows through the first and second seal rings and the inner passage; and wherein in the open position of the slide, the center aperture is aligned with the supply port allowing the pressurized lubricant to enter a body-cavity through the through port and exit through the outlet port to form a flow path for the flow of pressurized lubricant to the cavity of the fracking valve.

2. The fracking stack assembly of claim 1, wherein the linear shear-flow controller is configured such that in the blocked position and the open position, equal pressure is applied on the first and second sides of the slide by the flow of pressurized lubricant.

3. The fracking stack assembly of claim 1, wherein the flow path is configured to remove debris from the cavity of the fracking valve.

4. The fracking stack assembly of claim 1, wherein the flow path is in fluid communication with the cavity of the fracking valve, and wherein the flow path distributes the pressurized lubricant from the hydraulic pump to the cavity of the fracking valve.

5. The fracking stack assembly of claim 1, further comprising a piston coupled with the first end of the slide and disposed within a cylinder having first and second pilot ports for moving the slide between the blocked position and the open position.

6. The fracking stack assembly of claim 1, further comprising a spring coupled with the first end of the slide for biasing the slide into the blocked position.

7. The fracking stack assembly of claim 1, further comprising:

a first piston coupled with the first end of the slide and disposed within a first cylinder having first and second pilot ports for moving the slide into the open position; and a spring coupled with the slide for biasing the slide into the blocked position.

8. An oil well fracking stack assembly coupled with a wellhead, the fracking stack assembly comprising:

a hydraulic pump and a motor for powering the hydraulic pump;

at least one pressure accumulator tank for providing a flow of pressurized lubricant;

at least one conduit hydraulically coupling the hydraulic pump with the at least one pressure accumulator tank;

a fracking valve including a cavity within a body of the fracking valve; and a linear shear-flow valve for delivering the flow of pressurized lubricant at a set pressure to the cavity of the fracking valve comprising:

a valve assembly including:

a housing having an interior volume;

an inlet port coupled with the at least one pressure accumulator tank and receiving the flow of pressurized lubricant, the inlet port including first and second openings in the housing, a first holder disposed in the first opening and a first ring coupled within the first holder, a second holder disposed in the second opening and a second ring coupled within the second holder;

an outlet port including a third opening in the housing, a third holder disposed in the third opening and a third ring coupled within the third holder; and a movable member disposed within the interior volume and movable along a linear axis, the movable member including a first face and a second face opposite the first face, a closed valve aperture, and an open valve aperture in communication with the interior volume;

wherein in a closed position of the movable member, the closed valve aperture is aligned with the inlet port, in an open position of the movable member, the open valve aperture is aligned with the inlet port; and a pressure set assembly coupled with a first end of the movable member and configured to apply a set force to the movable member, the set force corresponding to the set pressure;

wherein when a pressure within the interior volume is below the set pressure, the set force moves the movable member into the open position; and wherein when the pressure within the interior volume is at the set pressure, the movable member moves into the closed position.

9. The fracking stack assembly of claim 8, wherein the pressure set assembly further comprises:

a first piston coupled to the first end of the movable member; and a second piston and a spring coupled to a second end of the movable member, the spring configured for biasing the movable member into any of the open or closed positions, depending on the configuration of the spring.

10. The fracking stack assembly of claim 8, wherein the pressure set assembly further comprises a pilot for receiving a pilot pressure, the pilot pressure in communication with the first end of the movable member and the pilot pressure of the pilot adjustable to modify the set force.

11. The fracking stack assembly of claim 10, wherein the pilot is a hydraulic pilot and further comprising a fluid compensator in fluid communication with the hydraulic pilot and the first end of the movable member.

12. The fracking stack assembly of claim 10, further comprising a fail-safe operator comprising a spring configured to automatically exert an opening force on the first end of the movable member when the pilot pressure falls below a set threshold.

13. The fracking stack assembly of claim 8, further comprising a manifold, the manifold comprising:

a main lubricant supply input conduit;

a plurality of apertures disposed on a first face and a second face of the manifold connected with the main lubricant supply input conduit, the plurality of apertures fluidly connects the main lubricant supply input conduit to the inlet port; and a second plurality of apertures disposed on the first face and the second face of the manifold connected with a plurality of output lubricant supply conduits, wherein the second plurality of apertures fluidly connects to the outlet port.

14. An oil well fracking stack assembly coupled with a wellhead, the fracking stack assembly comprising:

a hydraulic pump and a motor for powering the hydraulic pump;

at least one pressure accumulator tank for providing a flow of pressurized lubricant;

at least one conduit hydraulically coupling the hydraulic pump with the at least one pressure accumulator tank;

a fracking valve including a cavity within a body of the fracking valve; and a valve controller for delivering the flow of pressurized lubricant to the fracking valve comprising:

a manifold including:

a main lubricant supply input conduit;

a plurality of apertures disposed on a first face and a second face of the manifold connected with the main lubricant supply input conduit; and a second plurality of apertures disposed on the first face and the second face of the manifold connected with a plurality of output lubricant supply conduits; and a linear shear-flow valve having a first side coupled to the manifold and including:

a housing having an interior space;

a first port including first and second apertures in the housing, a first ring holder disposed in the first aperture and a first seal ring coupled within the first ring holder, a second ring holder disposed in the second aperture and a second seal ring coupled within the second ring holder, wherein in the first port is in fluid communication with a first aperture of the plurality of apertures;

a second port, including a third aperture in the housing, a third ring holder disposed in the third aperture, wherein the second port is in fluid communication with the second plurality of apertures; and a first slide disposed within the interior space and movable along a first linear axis, the first slide including a first side and a second side opposite the first side, a closed valve aperture, and an open valve aperture in communication with the second port;

wherein the first side of the first slide sealingly engages with the first seal ring, and the second side of the first slide sealingly engages with the second seal ring, the first slide slideable along the first linear axis between a return position, in which the closed valve aperture is aligned with the first port, and a supply position, in which the open valve aperture is aligned with the first port.

15. The fracking stack assembly of claim 14, wherein an equal pressure is applied on the first and second sides of the first slide by the flow of pressurized lubricant in the closed position.

16. The fracking stack assembly of claim 14, wherein the second plurality of apertures are coupled with the cavity of the fracking valve.

17. The fracking stack assembly of claim 14, further comprising a slide actuator having a cylinder having a piston disposed therein, the piston coupled with the first slide.

18. The fracking stack assembly of claim 17, wherein the linear shear-flow valve includes a pilot port, the pilot port in communication with the cylinder of the slide actuator and configured to move the piston and the first slide.

19. The fracking stack assembly of claim 17, further comprising a spring for biasing the first slide into a blocked position.

20. A fracking stack assembly coupled with a wellhead, comprising:

a hydraulic pump and a motor for powering the hydraulic pump;

at least one lubricant reservoir for providing a flow of pressurized lubricant;

at least one conduit hydraulically coupling the hydraulic pump with the at least one lubricant reservoir;

a fracking valve including a cavity within a body of the fracking valve;

a linear shear-flow controller delivering the flow of pressurized lubricant to the fracking valve comprising:

a housing including an interior space;

a supply port receiving the flow of pressurized lubricant and including first and second apertures in the housing, a first ring holder disposed in the first aperture and a bidirectional seal coupled within the first ring holder, a second ring holder disposed in the second aperture and a seal ring coupled within the second ring holder;

an outlet port, including a third aperture in the housing, a third ring holder disposed in the third aperture; and a slide having a first end and a second end disposed within the interior space and movable along a linear axis, the slide including a first side and a second side opposite the first side, an inner passage and a center aperture extending through the slide between the first and the second end, the center aperture connected to a through port extending through the slide;

wherein the first side of the slide sealingly engages with the bidirectional seal, and the second side of the slide sealingly engages with the seal ring, the slide slideable along the linear axis between blocked and open positions;

wherein in the blocked position of the slide, the center aperture is aligned between the supply port and outlet port and aligned along with the bidirectional seal and the seal ring, wherein the pressurized lubricant flows through the bidirectional seal, the seal ring, and the inner passage; and wherein in the open position of the slide, the center aperture is aligned with the supply port allowing the pressurized lubricant to enter a body-cavity through the through port and exit through the outlet port to form a flow path for the flow of pressurized lubricant to the cavity of the fracking valve.

21. The fracking stack assembly of claim 20, wherein the flow path is configured to remove debris from the cavity of the fracking valve.

* * * * *